US009557014B2

(12) United States Patent
Shigematsu

(10) Patent No.: US 9,557,014 B2
(45) Date of Patent: Jan. 31, 2017

(54) SIGNAL INDICATOR LAMP

(71) Applicant: PATLITE CORPORATION, Osaka (JP)

(72) Inventor: Daisuke Shigematsu, Osaka (KR)

(73) Assignee: PATLITE Corporation, Osaka (JP)

( * ) Notice: Subject to any disclaimer, the term of this patent is extended or adjusted under 35 U.S.C. 154(b) by 134 days.

(21) Appl. No.: 14/405,062

(22) PCT Filed: Oct. 2, 2013

(86) PCT No.: PCT/JP2013/076878
§ 371 (c)(1),
(2) Date: Dec. 2, 2014

(87) PCT Pub. No.: WO2015/049749
PCT Pub. Date: Apr. 9, 2015

(65) Prior Publication Data

US 2015/0323142 A1 Nov. 12, 2015

(51) Int. Cl.
*F21K 99/00* (2016.01)
*F21W 111/00* (2006.01)
*F21Y 101/00* (2016.01)

(52) U.S. Cl.
CPC . *F21K 9/52* (2013.01); *F21K 9/61* (2016.08); *F21W 2111/00* (2013.01); *F21Y 2101/00* (2013.01)

(58) Field of Classification Search
CPC ..... F21K 9/52; F21K 9/30; F21Y 2101/00; F21S 4/20; F21W 2111/00; F21V 5/043; F21V 5/046
See application file for complete search history.

(56) References Cited

U.S. PATENT DOCUMENTS 4,984,142 A * 1/1991 Garnerone ..... G08B 5/36 362/236
6,874,924 B1 * 4/2005 Hulse ..... F21S 4/20 362/219

(Continued)

FOREIGN PATENT DOCUMENTS

JP 0369804 U 7/1991
JP 2002-203405 A 7/2002

(Continued)

OTHER PUBLICATIONS

International Preliminary Report on Patentability (including Written Opinion of the ISA) mailed Apr. 14, 2016 in International Application No. PCT/JP2013/076878.

(Continued)

*Primary Examiner* — Julie Bannan
(74) *Attorney, Agent, or Firm* — Plumsea Law Group, LLC.

(57) ABSTRACT

A signal indicator lamp includes an LED mounting substrate 2, and is made up of a plurality of consecutively provided lens units 3 with cylindrical light guiding radiation portions 20 provided so as to enclose the LED mounting substrate 2. An LED 14 is mounted at a position biased to the side of an end portion 2D from a central position 2C in a short-side direction S of the LED mounting substrate 2. In the light guiding radiation portion 20, a slit portion 23 is defined which is cut away in an axial direction X such that the LED 14 is arranged therein when the lens unit 3 encloses the LED mounting substrate 2. Light made incident into the lens unit 3 from incident surfaces 24 being a pair of opposite end faces of the slit portion 23 is guided by the light guiding radiation portion 20, and is radiated outward in the entire circumferential region thereof.

6 Claims, 26 Drawing Sheets

(56) References Cited

U.S. PATENT DOCUMENTS

| | | | | |
|---|---|---|---|---|
| 2008/0211429 | A1* | 9/2008 | Saito | F21K 9/52 315/312 |
| 2009/0161359 | A1* | 6/2009 | Siemiet | F21S 4/28 362/235 |
| 2010/0124243 | A1* | 5/2010 | Hussell | F21K 9/00 372/45.01 |
| 2010/0214764 | A1* | 8/2010 | Chaves | G02B 6/0096 362/84 |
| 2010/0315811 | A1* | 12/2010 | Chen | F21V 13/04 362/235 |
| 2013/0114268 | A1* | 5/2013 | Shigematsu | F21S 8/00 362/308 |
| 2013/0314916 | A1* | 11/2013 | Clore | F21V 5/04 362/235 |
| 2015/0198317 | A1* | 7/2015 | Feller | H05B 33/0842 362/249.01 |

FOREIGN PATENT DOCUMENTS

| | | | |
|---|---|---|---|
| JP | 3169445 | U | 7/2011 |
| JP | 2012253043 | A | 12/2012 |
| WO | 0001986 | A1 | 1/2000 |
| WO | 2009064472 | A1 | 5/2009 |
| WO | 2009125160 | A1 | 10/2009 |

OTHER PUBLICATIONS

International Search Report and Written Opinion mailed Feb. 10, 2013 in PCT/JP2013/076878.

European Search Report issued May 6, 2016 in European Patent Application No. 13886162.0.

* cited by examiner

SIGNAL INDICATOR LAMP

TECHNICAL FIELD

The present invention relates to a signal indicator lamp.

BACKGROUND ART

A common signal indicator lamp is a cylindrical body, and can radiate light across the entire region in its circumferential direction.

In a light indicator device proposed in the following Patent Literature 1 as an example of the signal indicator lamp, a light-emitting diode substrate and a case that stores the substrate are included. On the substrate, a plurality of light source portions made up of LEDs are disposed. The case includes a base portion in a circular cylindrical shape with a bottom and three covers having translucency and showing circular cylindrical shapes. These covers are connected in three stages stacked with respect to the base portion. Each cover has a ring-shaped top wall at the inner peripheral side, and the top wall has a pair of bulging portions facing each other. At mutually opposite distal end portions in the pair of bulging portions, slits are defined. The substrate stored in the case is, inside of each cover, fitted in the respective slits of the pair of bulging portions. Light emitted from each light source portion of the substrate passes through the cover around the light source portion to be sent out to the outside.

CITATION LIST

Patent Literature

Patent Literature 1: Japanese Utility Model Registration No. 3169445

SUMMARY OF INVENTION

Technical Problem

In the signal indicator lamp, a new structure that leads to downsizing and simplification has constantly been demanded.

It is therefore an object of the present invention to provide a signal indicator lamp that leads to downsizing and simplification.

Solution to Problem

A first aspect of the invention to achieve the object mentioned above is a signal indicator lamp (1) including an LED mounting substrate (2) on which a plurality of sets of LEDs (14) are mounted in a long-side direction (L) at a predetermined interval, and made up of a plurality of consecutively provided lens units (3) with cylindrical light guiding radiation portions (20) provided so as to enclose the LED mounting substrate, characterized in that the LED is mounted at a position biased to an end portion (2D) side from a central position (2C) in a short-side direction (S) of the LED mounting substrate, in the light guiding radiation portion, a slit portion (23) is defined which is cut away in an axial direction (X) such that the LED is arranged therein when the lens unit encloses the LED mounting substrate, and a pair of opposite end faces of the slit portion are provided as incident surfaces (24) of LED radiation light, and light made incident into the lens unit from the incident surfaces is guided by the light guiding radiation portion, and is radiated outward in the entire circumferential region thereof.

In addition, in this section, alphanumeric characters in parentheses indicate reference signs of corresponding components in preferred embodiments to be described later, however, these reference signs are not intended to limit the present invention.

According to this arrangement, in the signal indicator lamp, in each of the lens units that enclose the LED mounting substrate in a state of being consecutively provided in plural numbers, a slit portion is defined in the cylindrical light guiding radiation portion. Moreover, in this slit portion, an LED mounted at a position biased to the end portion side in the short-side direction of the LED mounting substrate is arranged. The pair of opposite end faces of the slit portion serve as incident surfaces of LED radiation light. Thus, in each lens unit, light made incident into the lens unit from the incident surfaces is guided by the light guiding radiation portion, and is radiated outward in the entire circumferential region thereof.

With such an arrangement, in the signal indicator lamp, the LED mounting substrate and the lens unit can be arranged in a manner of being put together compactly so as to be as proximate as possible to each other. That is, a signal indicator lamp with a new structure that leads to downsizing and simplification can be provided.

A second aspect of the invention is the signal indicator lamp according to the first aspect of the invention, characterized in that the lens unit includes inside the light guiding radiation portion a cylindrical support portion (22) which supports another lens unit to be coupled from an axial direction, inside of the support portion, an insertion space (41) for the LED mounting substrate is defined, and the support portion is applied with a light shielding processing across the entire circumference.

According to this arrangement, the support portion can stabilize relative positions of the adjacently coupled lens units to each other. The inside of the support portion serves as an insertion space for the LED mounting substrate, and the support portion is applied with a light shielding processing across the entire circumference. Therefore, an adverse effect to be exerted on radiation characteristics of light in the light guiding radiation portion due to light leaked to the inside of the light guiding radiation portion being transmitted through the support portion and then being made incident onto the light guiding radiation portion can also be prevented. Light to be radiated to the outside from the light guiding radiation portion can thereby be emphasized. Further, the support portion can also function as a screen for the LED mounting substrate located inside thereof.

A third aspect of the invention is the signal indicator lamp according to the first or second aspect of the invention, characterized by including an auxiliary lens portion (21) which is provided so as to externally cover the slit portion, and outwardly radiates light leaked from the slit portion.

According to this arrangement, by outwardly radiating light leaked from the slit portion by the auxiliary lens portion, in the signal indicator lamp, light can be radiated outward in the entire circumferential region of the light guiding radiation portion.

A fourth aspect of the invention is the signal indicator lamp according to the third aspect of the invention, including a first movement restraining portion (27) which is provided in the auxiliary lens portion, is in a groove shape into which an end portion (2D) in the short-side direction of the LED mounting substrate is fitted, and restrains a movement in each of the short-side direction of the LED mounting substrate and a thickness direction (T) thereof.

According to this arrangement, the auxiliary lens portion can, at the first movement restraining portion, also restrain a movement in each of the short-side direction and thickness direction of the LED mounting substrate. The relative positions of the respective lens units and the LEDs located at the corresponding positions (the same positions in the long-side direction) in the LED mounting substrate can thereby be stabilized. Consequently, in the signal indicator lamp, light from the LEDs can be stably guided to the lens units for irradiation even if there is vibration.

A fifth aspect of the invention is the signal indicator lamp according to the fourth aspect of the invention, characterized by including a second movement restraining portion (36A) which is provided at a side opposite to the auxiliary lens portion in the short-side direction of the LED mounting substrate, and restrains a movement of the LED mounting substrate to said opposite side.

According to this arrangement, because a movement of the LED mounting substrate to the side opposite to the auxiliary lens portion can be restrained by the second movement restraining portion, the relative positions of the respective lens units and the LEDs located at the corresponding positions in the LED mounting substrate can be further stabilized.

A sixth aspect of the invention is the signal indicator lamp according to any one of the first to fifth aspects of the invention, characterized in that the lens unit includes a pair of insertion space defining members (40) which extends along an axial direction and demarcate an insertion space (41) for the LED mounting substrate between each other's opposite faces (40A), and one-end portions (40B) in an axial direction of the pair of insertion space defining members are elastically deformable, and said one-end portions become proximate to each other as a result of entering between other-end portions (40C) in an axial direction of the pair of insertion space defining members of another lens unit, and sandwich the LED mounting substrate in a thickness direction.

According to this arrangement, in this signal indicator lamp, when a plurality of lens units are coupled in the axial direction, in the respective lens units, the one-end portions of the pair of insertion space defining members become proximate to each other due to elastic deformation as a result of entering between the other-end portions in the axial direction of the pair of insertion space defining members in another lens unit to be coupled, and sandwich the LED mounting substrate in the thickness direction. The relative positions of the respective lens units and the LEDs located at the corresponding positions in the LED mounting substrate can thereby be stabilized. Consequently, in the signal indicator lamp, light from the LEDs can be stably guided to the lens units for irradiation even if there is vibration.

A seventh aspect of the invention is the signal indicator lamp according to the sixth aspect of the invention, characterized in that the lens unit includes a reinforcing portion (42) that reinforces the other-end portions in an axial direction of the pair of insertion space defining members.

According to this arrangement, in each lens unit, the one-end portions in the axial direction of the pair of insertion space defining members, when entering between the other-end portions in the axial direction of the pair of insertion space defining members of another lens unit to be coupled, enter between said the other-end portions reinforced by the reinforcing portions. Therefore, said one-end portions can be reliably elastically deformed to become proximate to each other, and sandwich the LED mounting substrate in the thickness direction.

An eighth aspect of the invention is the signal indicator lamp according to any one of the first to seventh aspects of the invention, characterized by including an inner irradiation portion (80) which is provided inside the light guiding radiation portion, and irradiates light leaked to the inside of the light guiding radiation portion to the slit portion side.

According to this arrangement, because light leaked to the inside of the light guiding radiation portion is irradiated to the slit portion side by the inner irradiation portion, and then radiated outward from the slit portion, in the signal indicator lamp, the light quantity of light to be radiated outward from the light guiding radiation portion can be uniformized in the circumferential direction.

DESCRIPTION OF EMBODIMENTS

Hereinafter, a preferred embodiment of the present invention will be specifically described with reference to the drawings.

Figure 1:
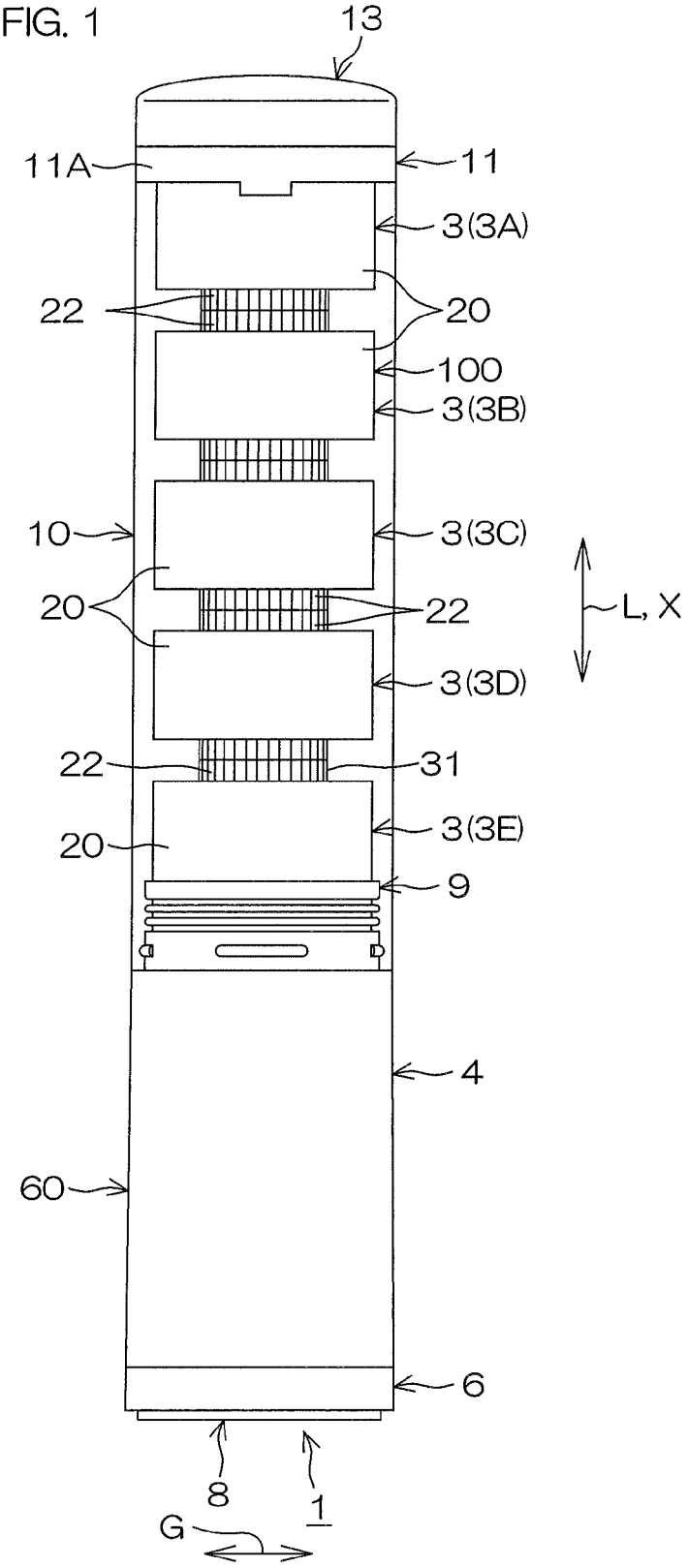
FIG. 1 is a front view of a signal indicator lamp 1 according to a preferred embodiment of the present invention.
Figure 2:
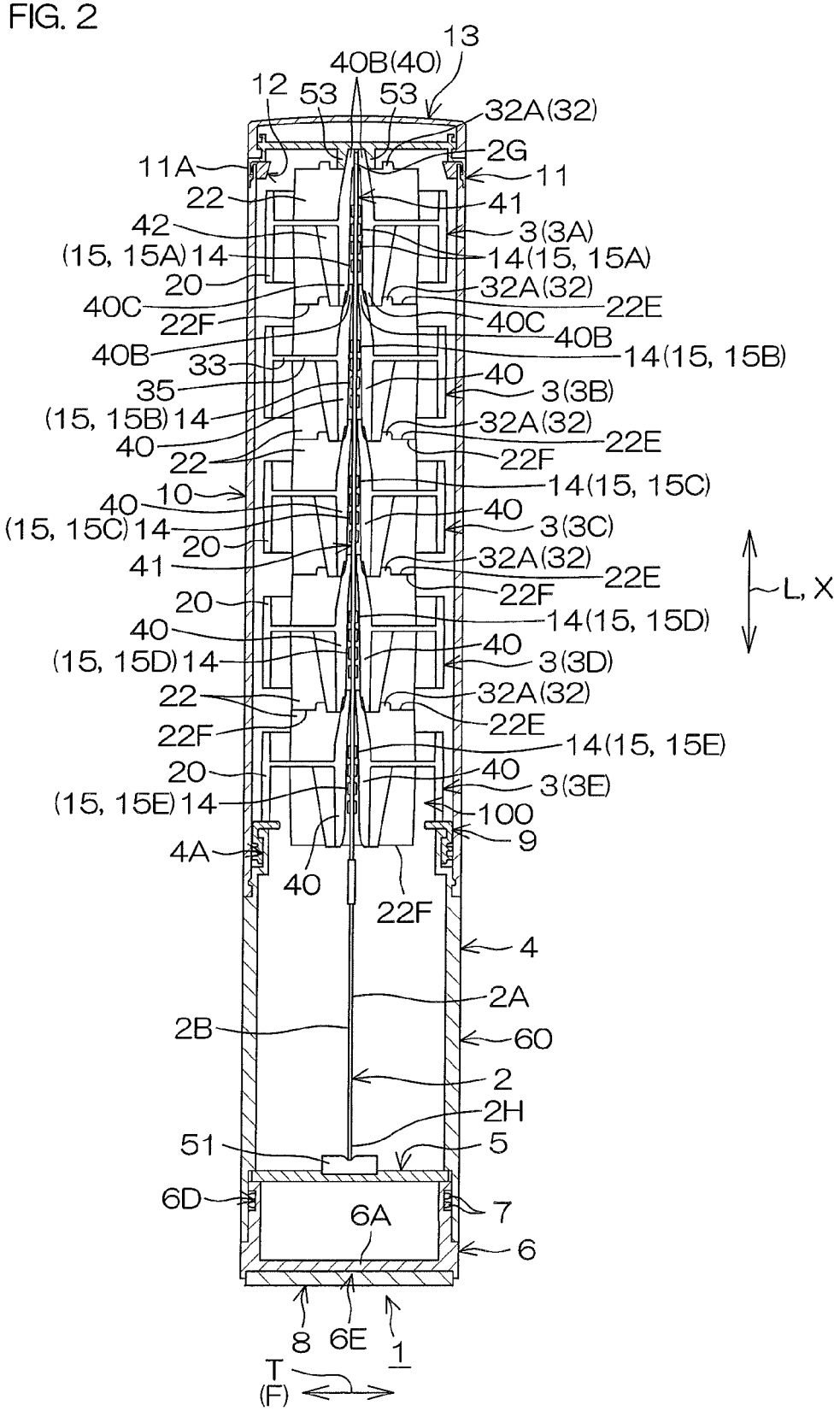
FIG. 2 is a central longitudinal side sectional view of the signal indicator lamp 1 in the posture of FIG. 1.
Figure 3A:
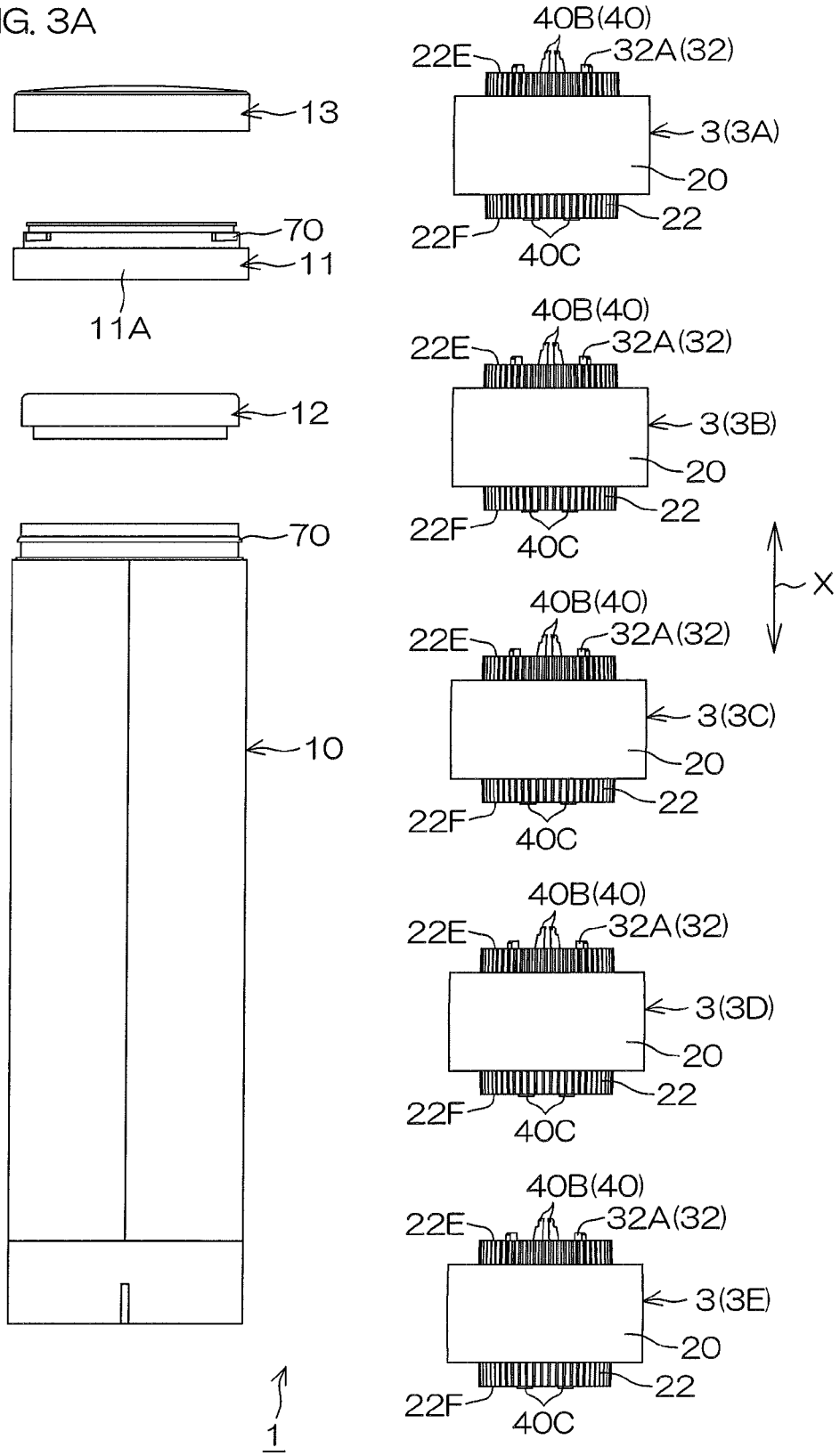
FIG. 3A is a front view of individual components of the signal indicator lamp 1.
Figure 3B:
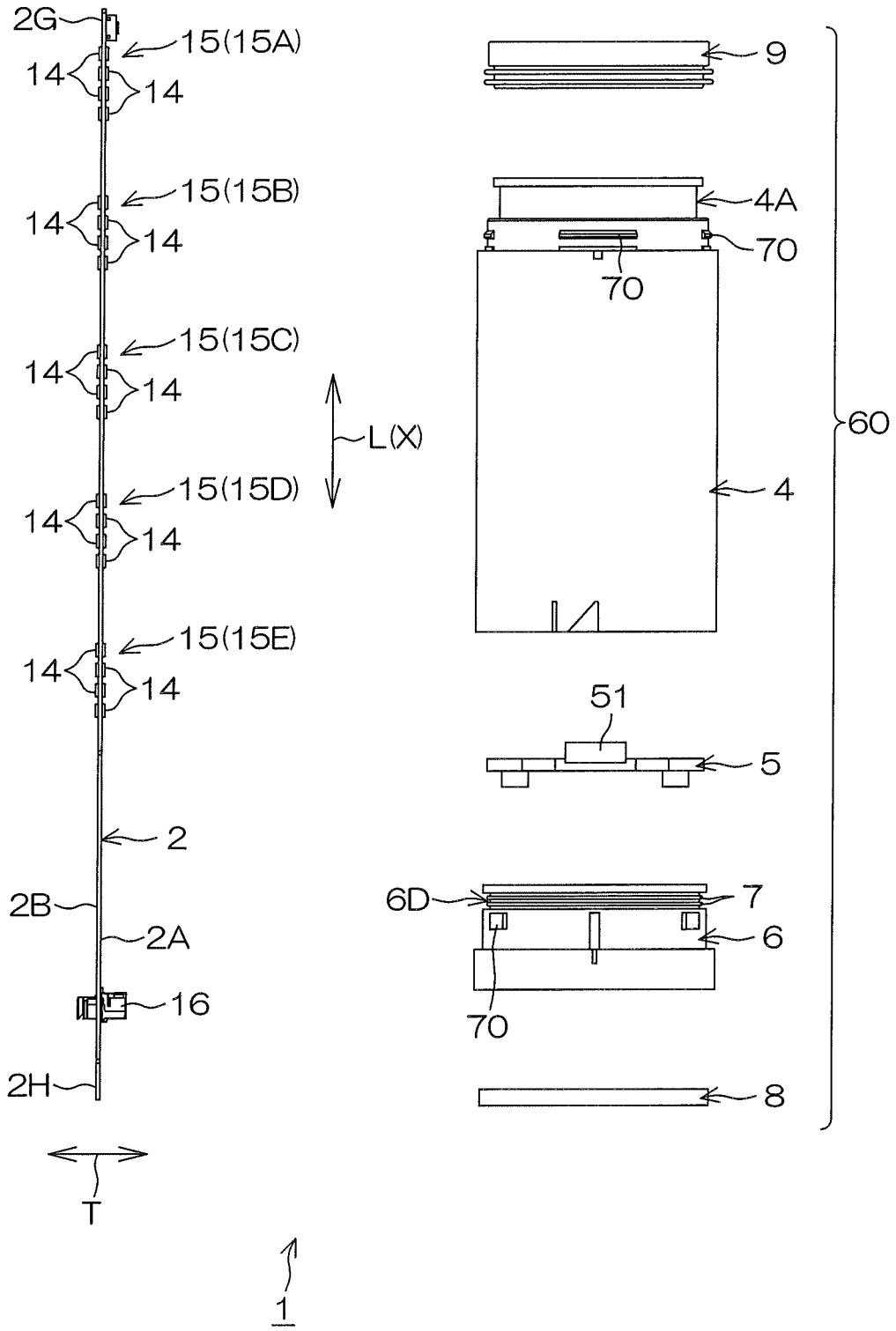
FIG. 3B is a front view of individual components (components not shown in FIG. 3A) of the signal indicator lamp 1.
Figure 4A:
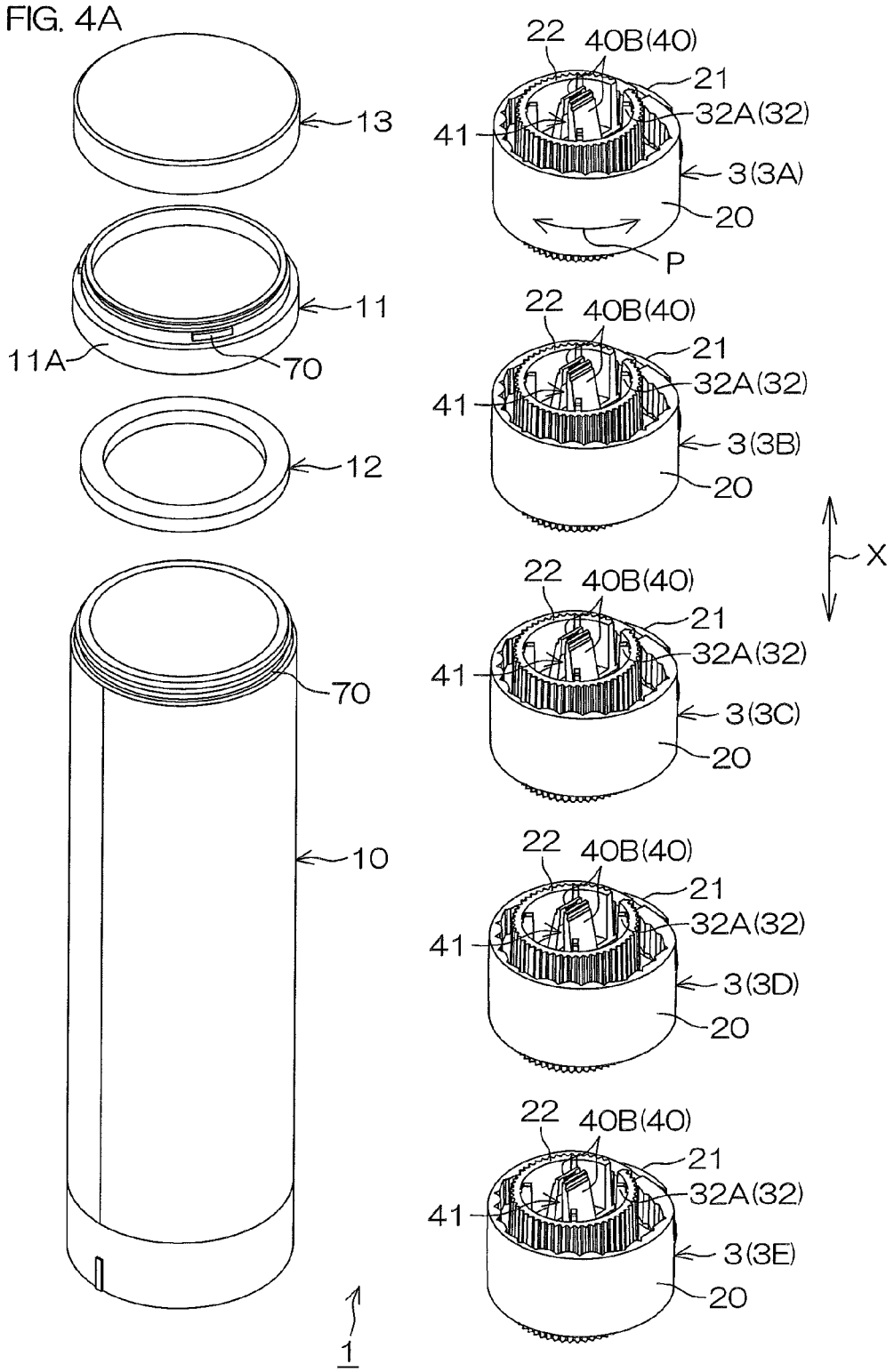
FIG. 4A is an exploded perspective view of the signal indicator lamp 1.
Figure 4B:
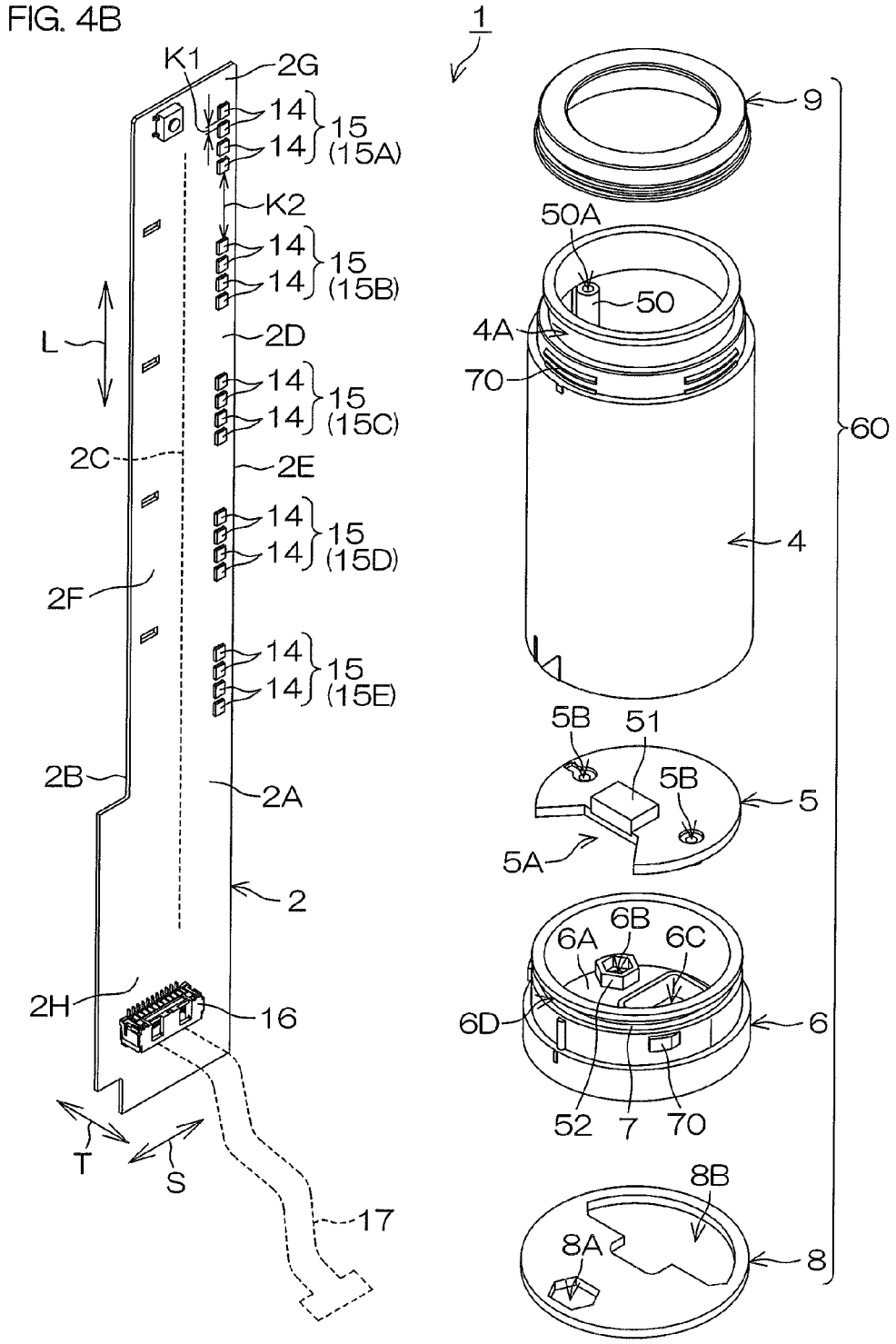
FIG. 4B is an exploded perspective view of the signal indicator lamp 1, and shows components not shown in FIG. 4A.
Figure 5A:
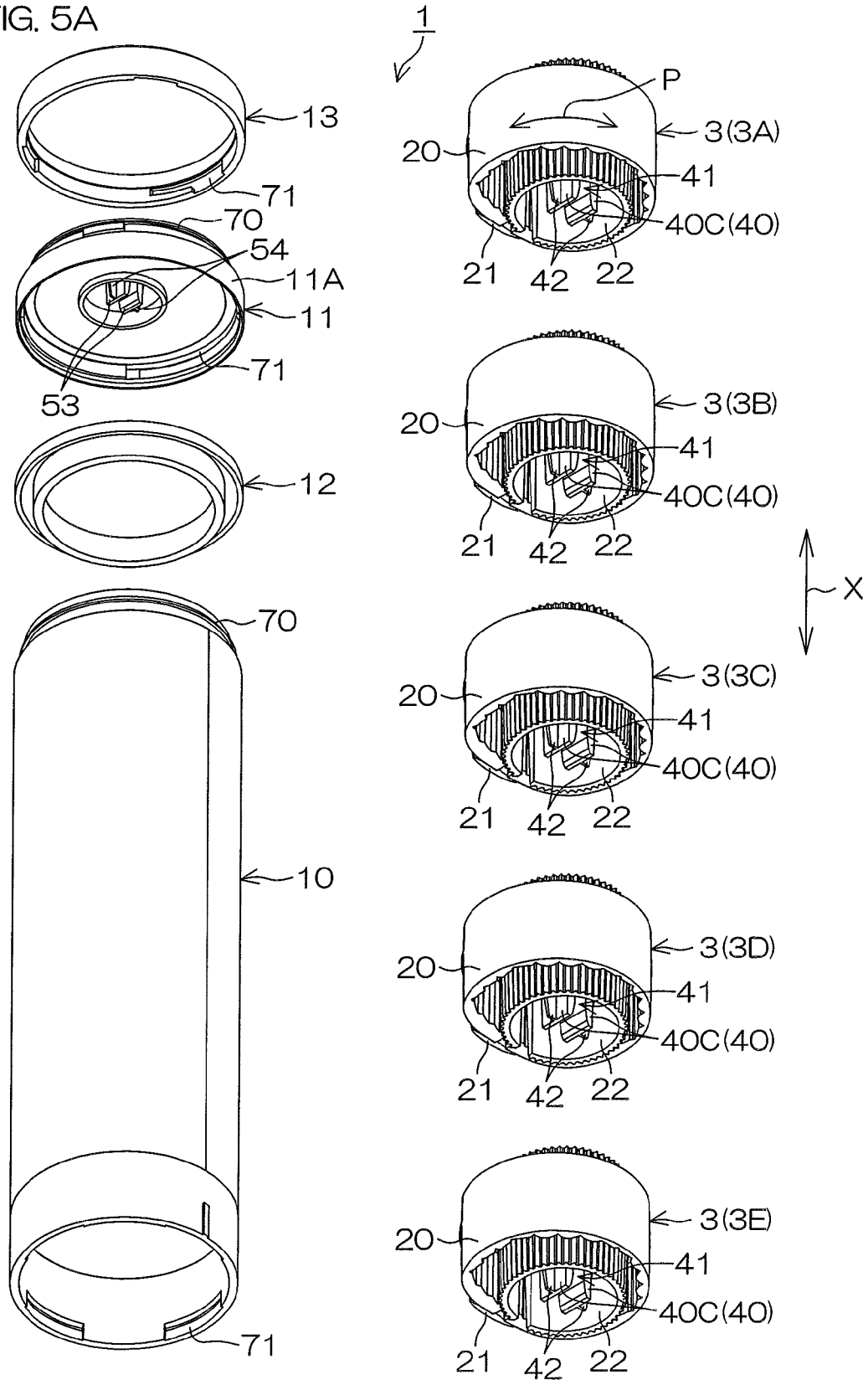
FIG. 5A is an exploded perspective view of the signal indicator lamp 1 when viewed from a direction different from that of FIG. 4A.
Figure 5B:
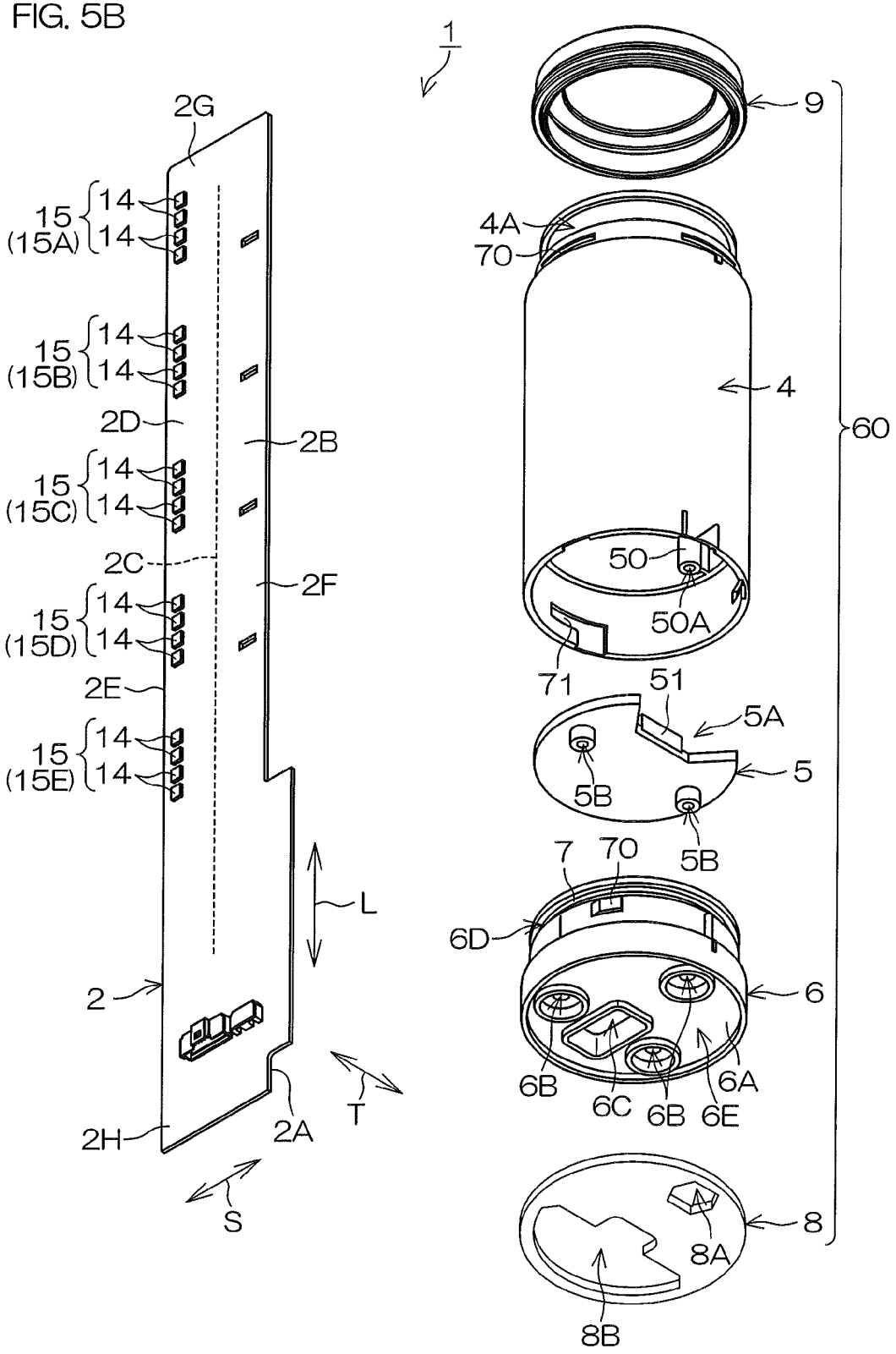
FIG. 5B is an exploded perspective view of the signal indicator lamp 1, and shows components not shown in FIG. 5A.

FIG. 1 is a front view of a signal indicator lamp 1 according to a preferred embodiment of the present invention. FIG. 2 is a central longitudinal side sectional view of the signal indicator lamp 1 in the posture of FIG. 1. FIG. 3A and FIG. 3B are front views of individual components of the signal indicator lamp 1. FIG. 4A and FIG. 4B are exploded perspective views of the signal indicator lamp 1. FIG. 5A and FIG. 5B are exploded perspective views of the signal indicator lamp 1 when viewed from a direction different from that of FIG. 4A and FIG. 4B.

Referring to FIG. 1 and FIG. 2, the signal indicator lamp 1 according to a preferred embodiment of the present invention is to be used at a manufacturing site or the like of a factory, and shows a long and narrow circular cylindrical shape. The posture of the signal indicator lamp 1 in use can be arbitrarily set according to service conditions. However, in the following, for the sake of convenience, description will be given based on the signal indicator lamp 1 when arranged to be longer than wide such that the vertical direction of the sheet plane in the respective views of FIG. 1 to FIG. 5B is coincident with the long-side direction of the signal indicator lamp 1. Specifically, description will be given, in the respective views of FIG. 1 to FIG. 5B, assuming the upper side of the sheet plane as the upper side of the signal indicator lamp 1, and the lower side of the sheet plane, as the lower side of the signal indicator lamp 1.

Referring to FIG. 3A to FIG. 5B, the signal indicator lamp 1 includes an LED mounting substrate 2, lens units 3, a body 4, a plate 5, a bracket 6, a waterproof ring 7, a waterproof sheet 8, a waterproof ring 9, an outer lens 10 (case portion), an outer top 11, a waterproof cap 12, and a head cover 13. In the following, the respective components will be individually described.

The LED mounting substrate 2 is, as shown in FIG. 4B and FIG. 5B, in a substantially oblong thin plate shape having a longer side in the vertical direction. The long-side direction (vertical direction) of the LED mounting substrate 2 will be denoted by reference sign L, the short-side direction of the LED mounting substrate 2 will be denoted by reference sign S, and the thickness direction of the LED mounting substrate 2 will be denoted by reference sign T. The dimension of the LED mounting substrate 2 in the long-side direction L is slightly smaller than the dimension in the long-side direction of the signal indicator lamp 1 (refer to FIG. 2). The LED mounting substrate 2 has a front surface 2A and a back surface 2B serving as both side surfaces in the thickness direction T. For the sake of convenience, the surface viewed to be the largest in FIG. 4B is assumed as the front surface 2A, and the surface viewed to be the largest in FIG. 5B is assumed as the back surface 2B. The long-side direction L and the short-side direction S are orthogonal to each other on an identical plane parallel to the front surface 2A and the back surface 2B. The thickness direction T is orthogonal to both of the long-side direction L and the short-side direction S. In addition, the thickness direction T is also a depth direction F of the signal indicator lamp 1 (refer to FIG. 2), and the short-side direction S is also a horizontal direction G of the signal indicator lamp 1 (refer to FIG. 1).

On each of the front surface 2A and the back surface 2B, at a position biased to the side of one end portion 2D from a central position 2C in the short-side direction S, an LED (light-emitting diode) 14 is mounted. The LED 14 mounted on the front surface 2A and the LED 14 mounted on the back surface 2B are at the same position (position slightly on the central position 2C side from an edge 2E in the end portion 2D) in the short-side direction S (refer to FIG. 4B and FIG. 5B).

On each of the front surface 2A and the back surface 2B, a plurality of LEDs 14 are mounted aligned in a row along the long-side direction L. Specifically, four LEDs 14 aligned at equal intervals along the long-side direction L compose one set 15, and five sets 15 are aligned at equal intervals along the long-side direction L. That is, the LED mounting substrate 2 is mounted with the plurality of sets of LEDs 14 at predetermined intervals in the long-side direction L. In addition, the interval K1 between adjacent LEDs 14 in each set 15 is narrower than the interval K2 between adjacent sets 15 (refer to FIG. 4B). Also, the individual LEDs 14 show small piece shapes. Moreover, in the respective sets 15, the LEDs 14 on the front surface 2A and the LEDs 14 on the back surface 2B are arranged one each at the same positions in the long-side direction L.

Said five sets 15 are, on each of the front surface 2A and the back surface 2B, arranged in a region of substantially three fourths on one side (upper side) in the long-side direction L. On each of the front surface 2A and the back surface 2B, when the five sets 15 are distinguished in order from the top, like the first set 15A, the second set 15B, the third set 15C, the fourth set 15D, and the fifth set 15E, the first set 15A is arranged in an upper end portion of the front surface 2A or the back surface 2B.

On the front surface 2A and the back surface 2B, in a region of substantially one fourth on the other side (lower side) in the long-side direction L, no LEDs 14 are arranged, and in said region of the front surface 2A, a terminal 16 is mounted. To the terminal 16, a cable 17 to perform supply of a control signal and electric power is connected. The terminal 16 and the respective LEDs 14 are electrically connected. The respective LEDs 14 emit light as a result of a control signal or electric power being supplied from the cable 17 via the terminal 16.

Next, the lens unit 3 will be described. The description of the lens unit 3 will be given based on the posture of the lens unit 3 when assembled into the signal indicator lamp 1 in each of FIG. 1 to FIG. 5.

Referring to FIG. 2, the same number of (that is, five) lens units 3 as the number of sets 15 of LEDs 14 described above are provided, and the respective lens units 3 are the same in form (shape and size). These five lens units 3 are used coupled in the vertical direction (long-side direction L of the LED mounting substrate 2). That is, each individual lens unit 3 is used with another lens unit 3 that is the same in form as itself being coupled in the long-side direction L, and in the signal indicator lamp 1, the plurality of (five) lens units 3 are consecutively provided. The five lens units 3 are sometimes distinguished in order from the top, like the first lens unit 3A, the second lens unit 3B, the third lens unit 3C, the fourth lens unit 3D, and the fifth lens unit 3E. The respective lens units 3 are the same in form, but may be colored in different colors. For example, the first lens unit 3A may be red, the second lens unit 3B may be orange, the third lens unit 3C may be green, the fourth lens unit 3D may be blue, and the fifth lens unit 3E may be white. Alternatively, the respective lens units 3 may be in the same color, while the emission color of the LEDs 14 to emit light toward the respective lens units 3 may be differentiated for each lens unit 3.

Figure 6:
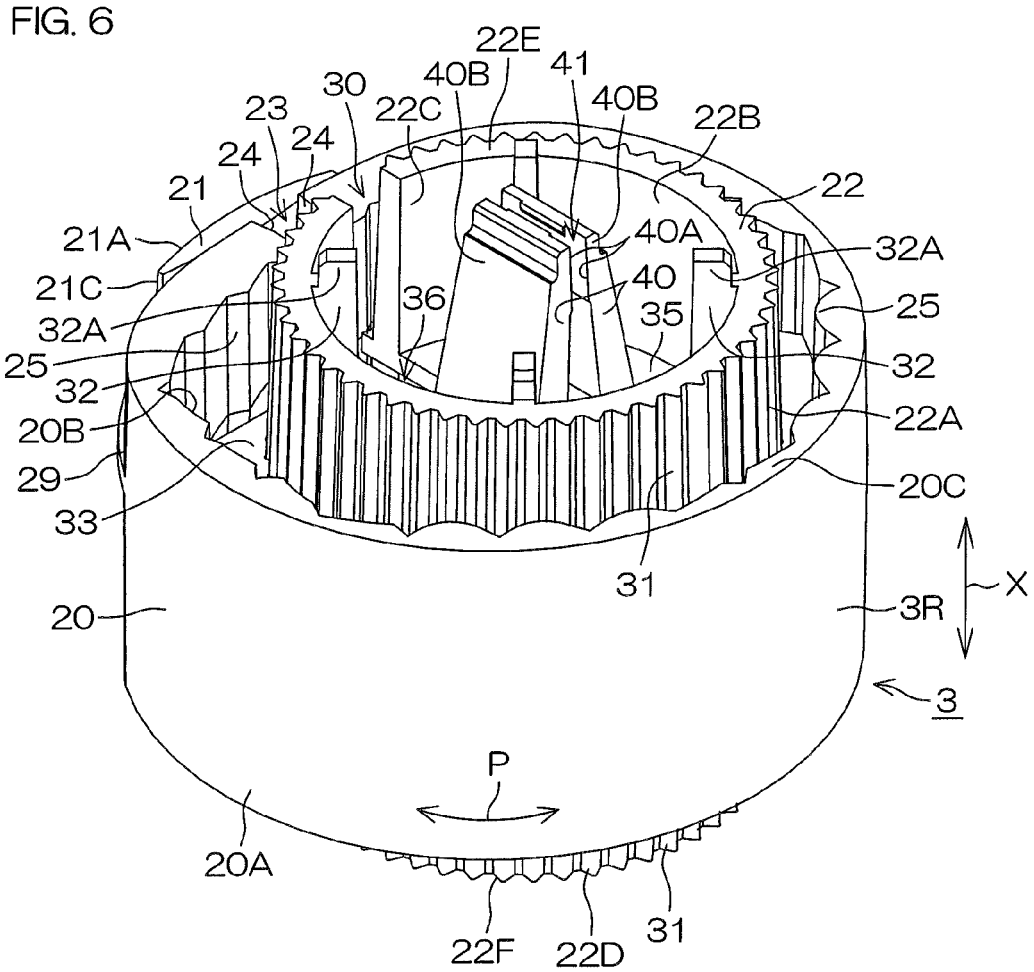
FIG. 6 is a perspective view of a lens unit 3 that is a constituent of the signal indicator lamp 1.
Figure 7:
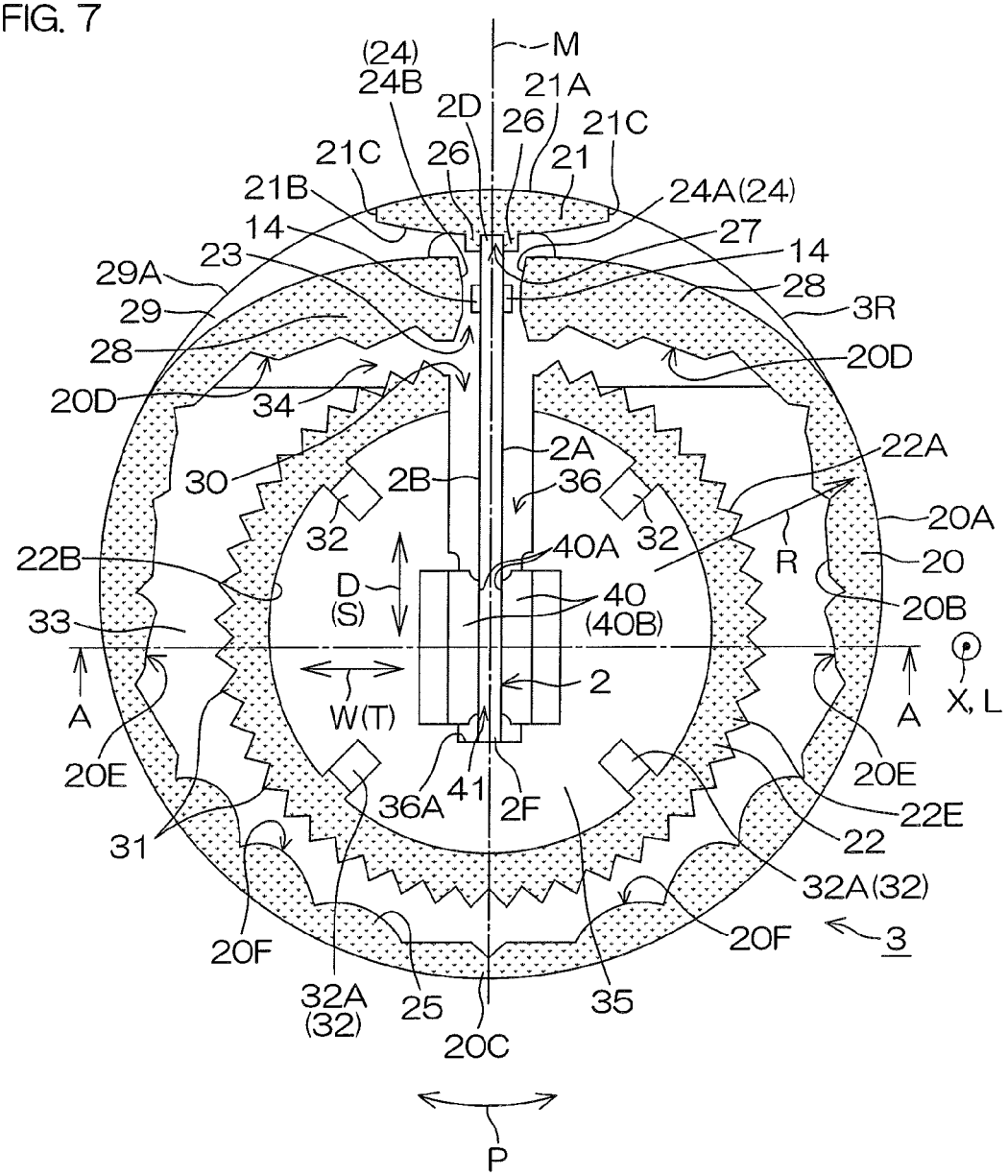
FIG. 7 is a plan view of the lens unit 3.
Figure 8:
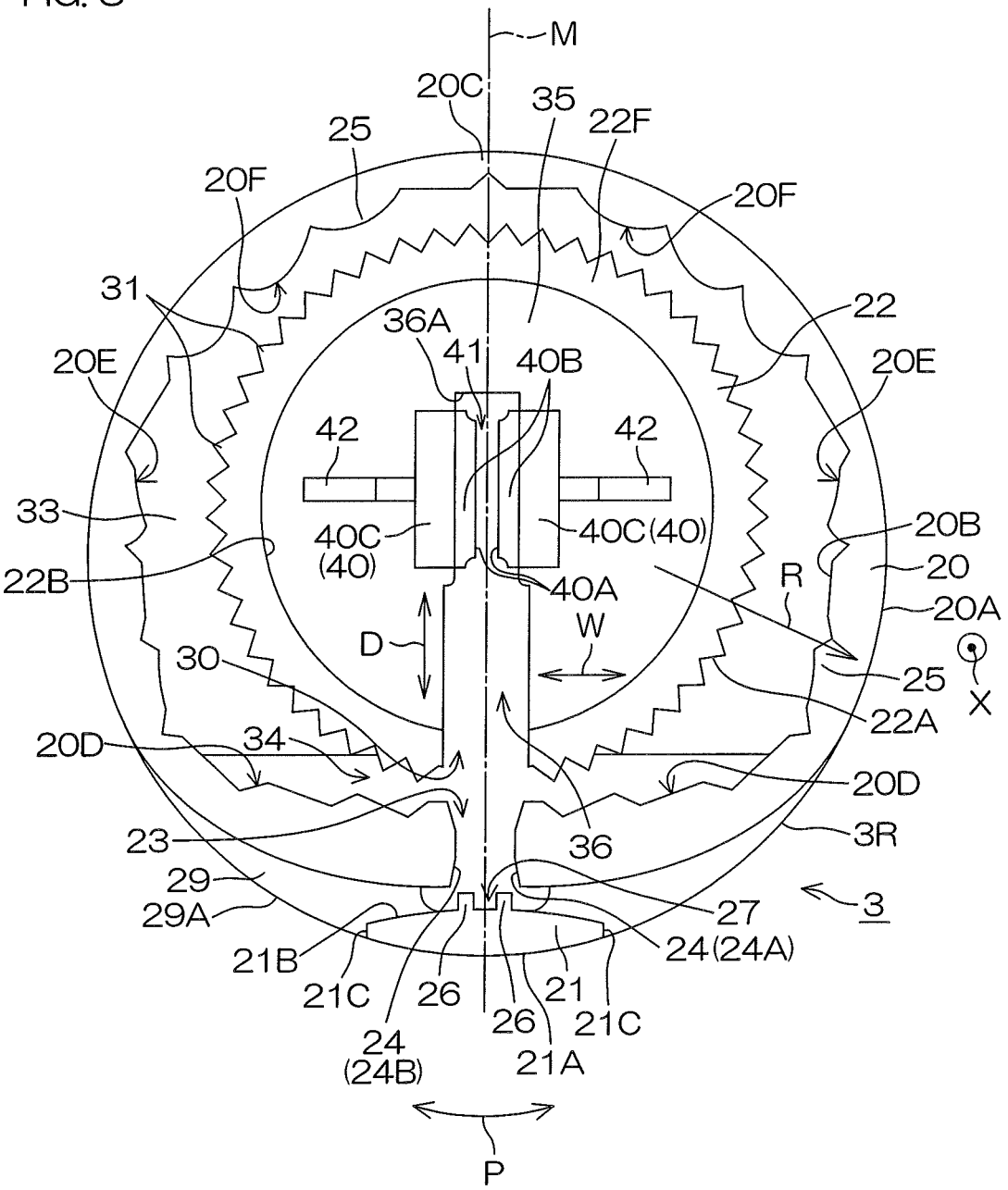
FIG. 8 is a bottom view of the lens unit 3.
Figure 9:
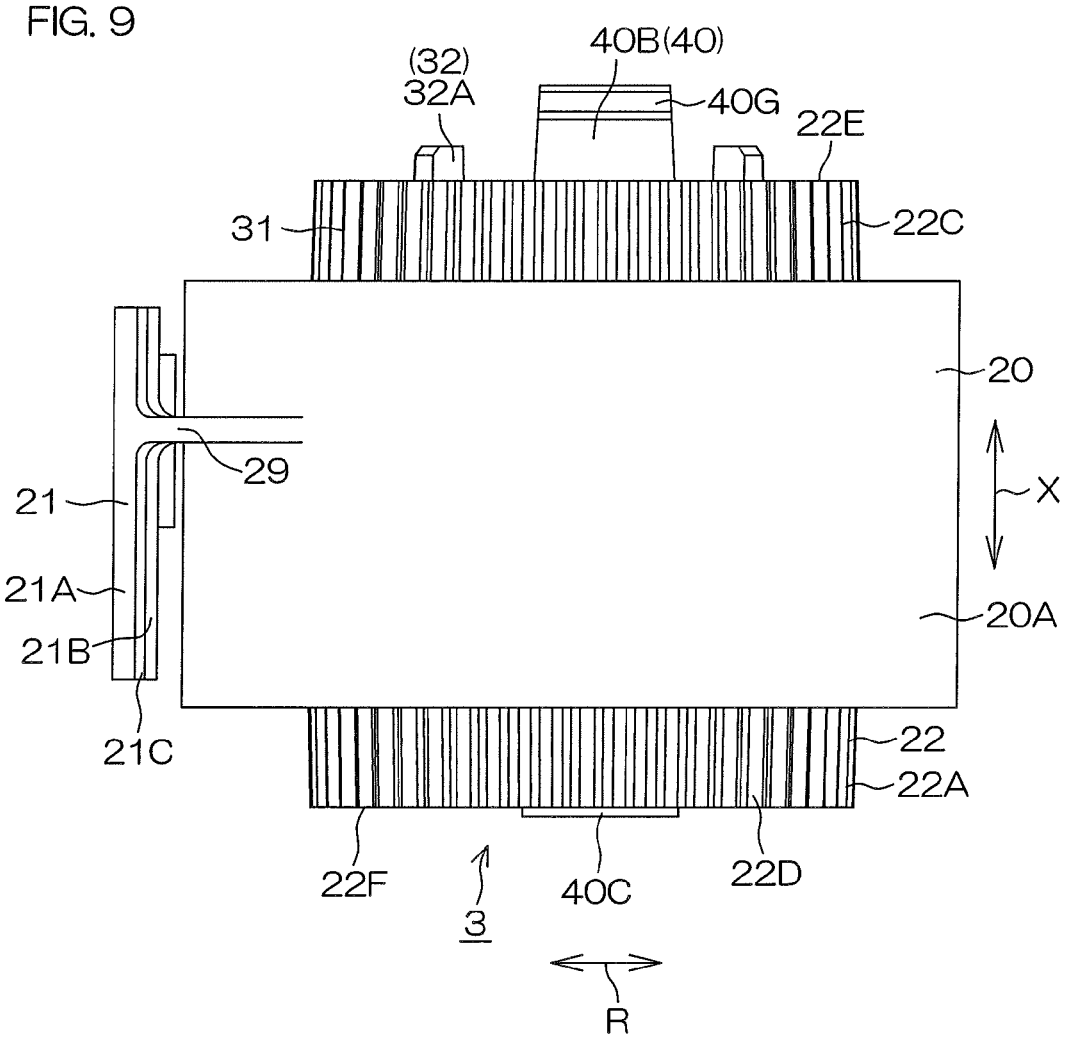
FIG. 9 is a left side view of the lens unit 3.
Figure 10:
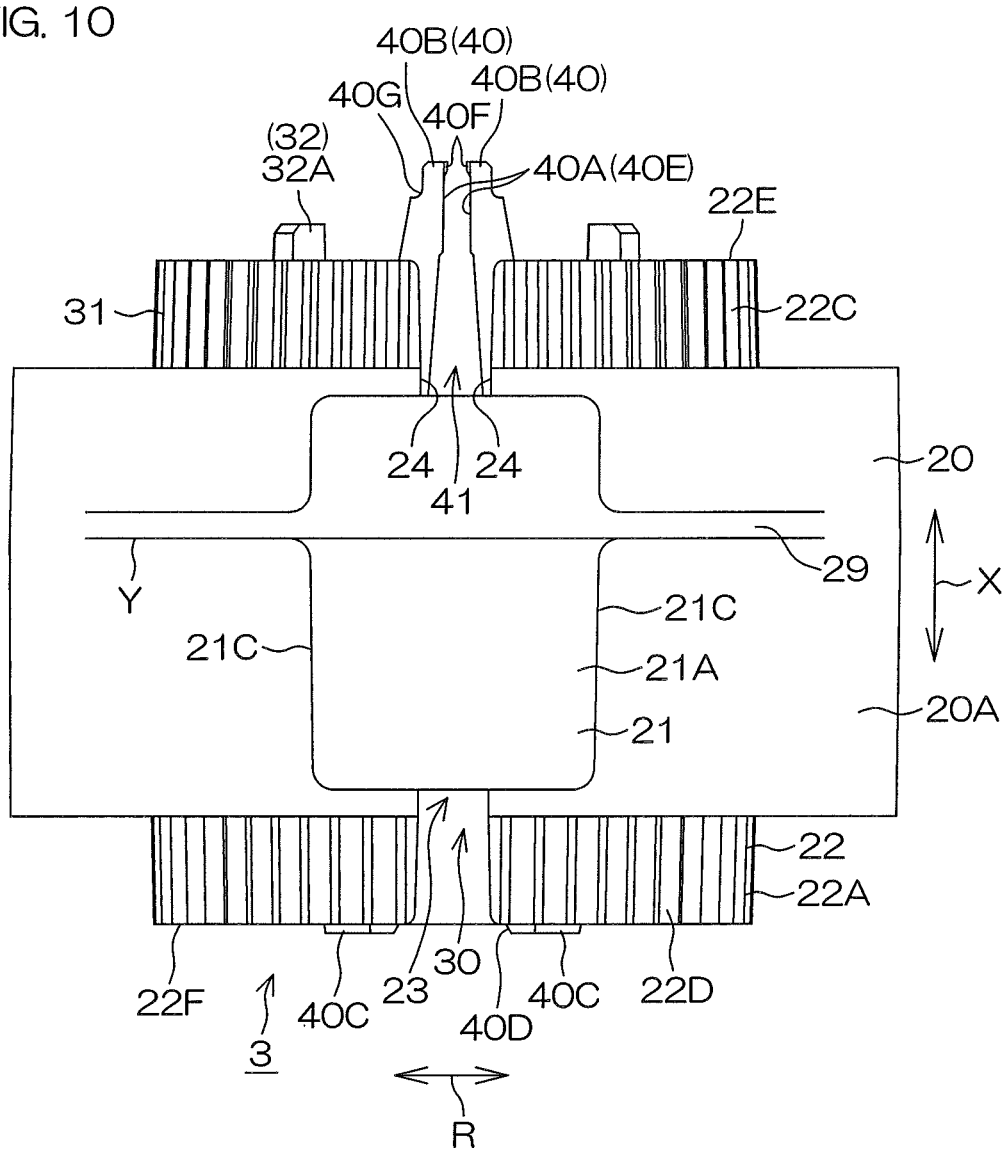
FIG. 10 is a back view of the lens unit 3.
Figure 11:
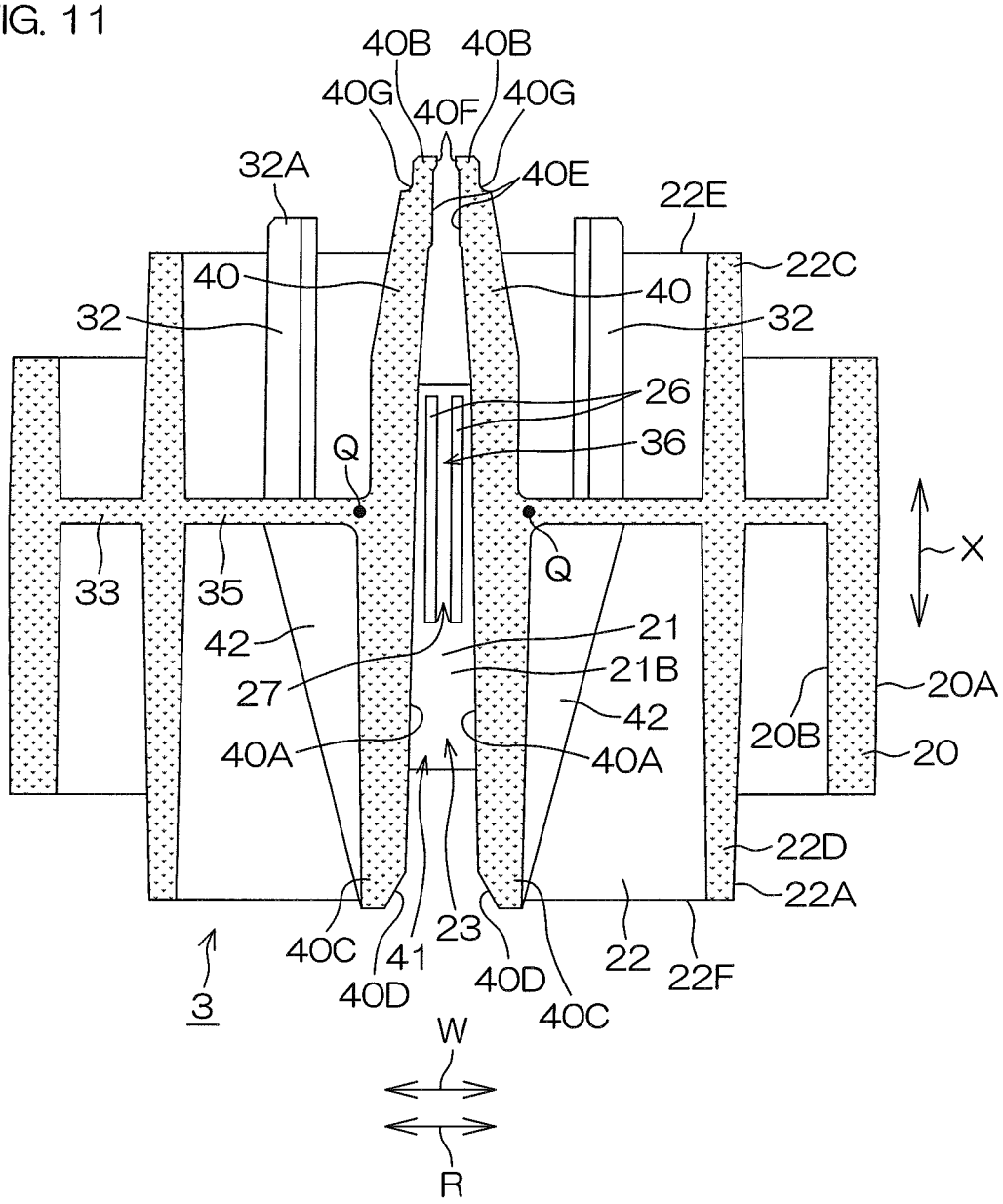
FIG. 11 is an A-A arrow view of FIG. 7.
Figure 12:
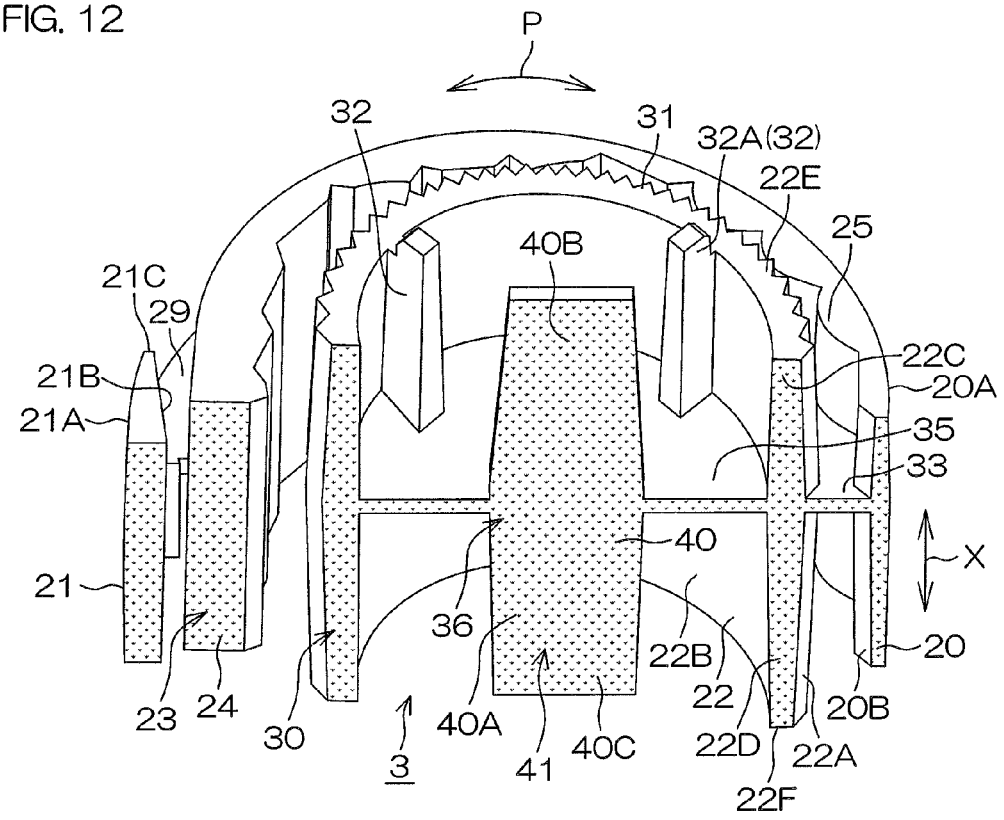
FIG. 12 is a perspective view of the principal part of the lens unit 3 shown in part by a section.
Figure 13:
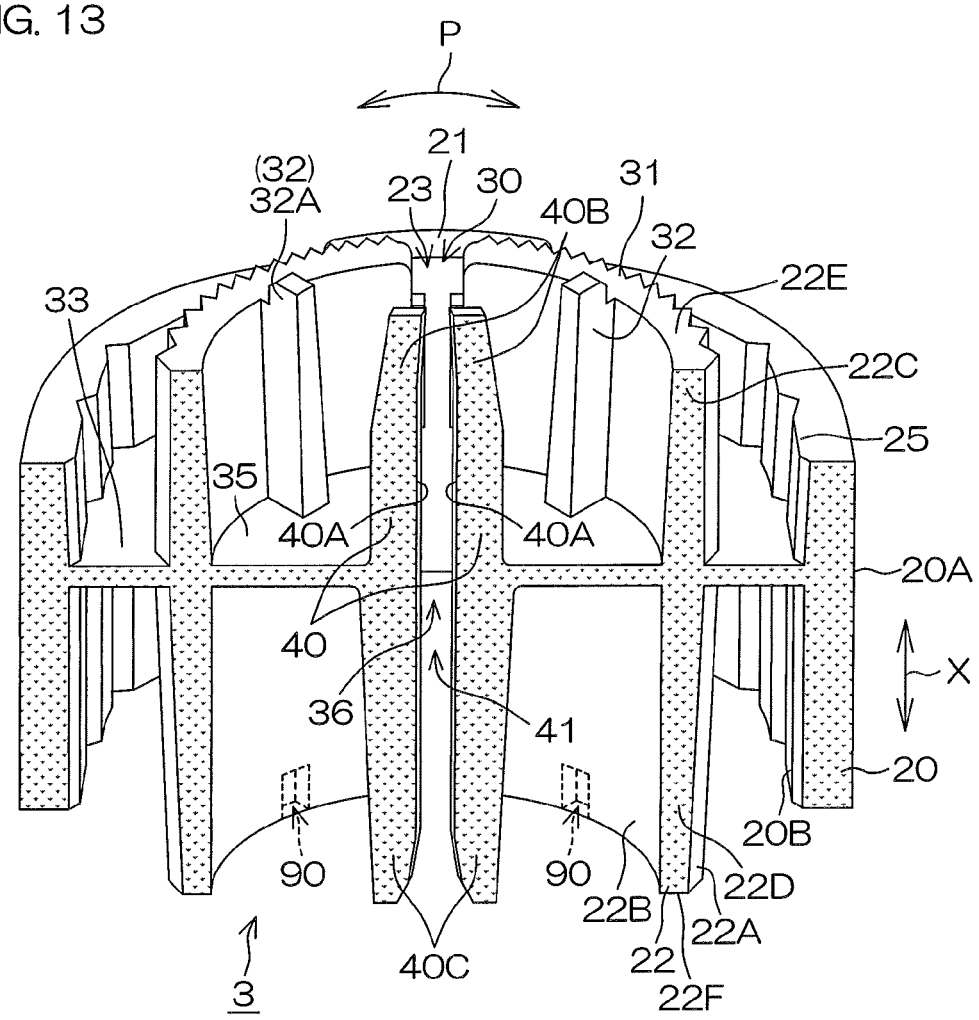
FIG. 13 is a perspective view of the principal part of the lens unit 3 shown in part by a section.

FIG. 6 is a perspective view of the lens unit 3. FIG. 7 is a plan view of the lens unit 3. FIG. 8 is a bottom view of the lens unit 3. FIG. 9 is a left side view of the lens unit 3. FIG. 10 is a back view of the lens unit 3. FIG. 11 is an A-A arrow view of FIG. 7. FIG. 12 and FIG. 13 are perspective views of the principal part of the lens unit 3 shown in part by a section.

Hereinafter, the individual lens units 3 will be described with reference to FIG. 6 to FIG. 13. In addition, for the sake of convenience, the LED mounting substrate 2 is not shown in the drawings other than FIG. 7 out of FIG. 6 to FIG. 13.

The lens unit 3 is in a substantially circular cylindrical shape. The direction in which a central axis (not shown) passing through the circle center of the lens unit 3 extends will be referred to as an axial direction X of the lens unit 3. The lens unit 3 has a predetermined length in the axial direction X. As shown in FIG. 7, the lens unit 3 when viewed from the axial direction X has an exterior contour 3R that is substantially circular. In the following, description will be sometimes given using a circumferential direction P and a radial direction R of the lens unit 3.

The lens unit 3 as a whole is made of a transparent resin (including a semi-transparent or colored transparent resin, the same applies to the following) as its material, and is molded using molds by extrusion molding or the like. Respective parts (to be described from now on) in the lens unit 3 are integrated. As the resin to be used herein, an acrylic resin can be mentioned.

The lens unit 3 mainly includes a light guiding radiation portion 20, an auxiliary lens portion 21, and a support portion 22 (refer to the dotted parts in FIG. 7).

The light guiding radiation portion 20 is in a cylindrical shape (a substantially circular cylindrical shape in detail) that forms most of the exterior contour 3R of the lens unit 3. Therefore, the circumferential direction of the light guiding radiation portion 20 is the same as the circumferential direction P described above, and the radial direction of the light guiding radiation portion 20 is the same as the radial direction R described above. At one spot on the circumference of the light guiding radiation portion 20, a slit portion 23 is defined. The slit portion 23 cuts away the light guiding radiation portion 20 in the axial direction X, and cuts one spot on the circumference of the light guiding radiation portion 20 along the axial direction X. Therefore, the light guiding radiation portion 20 when cut along a cutting plane orthogonal to the axial direction X has a section showing, in a strict sense, a substantially C shape that is broken at the slit portion 23. In the light guiding radiation portion 20, a pair of opposite end faces to demarcate the slit portion 23 are formed, and these opposite end faces will be called incident surfaces 24. One (the right side in FIG. 7) of the pair of incident surfaces 24 will be referred to as an incident surface 24A, and the other (the left side in FIG. 7) will be referred to as an incident surface 24B. These incident surfaces 24 are arranged opposed to each other across the slit portion 23. These incident surfaces 24 may be flat surfaces extending in parallel, or may be, as shown in FIG. 7, bulged in substantially arc shapes in mutually approaching directions.

Parts (which will be referred to as incident portions 28) at the sides close to the respective incident surfaces 24 in the light guiding radiation portion 20 are located on the inside (the side of the circle center of the lens unit 3) further than the exterior contour 3R of the lens unit 3, and are not constituents of the exterior contour 3R. A region other than the respective incident portions 28 in an outer peripheral surface 20A of the light guiding radiation portion 20 constitutes most of the exterior contour 3R.

At an inner peripheral surface 20B of the light guiding radiation portion 20, a plurality of projection portions 25 are integrally provided. These projection portions 25 are in streak shapes that project to the circle center side of the lens unit 3 (inside in the radial direction R) while extending linearly along the axial direction X. The respective projection portions 25 when cut along a cutting plane orthogonal to the axial direction X have sectional shapes that are different depending on the position in the circumferential direction P of the inner peripheral surface 20B. In detail, in the light guiding radiation portion 20, a position shifted by 180 degrees from the slit portion 23 in the circumferential direction P is called an opposite position 20C, and a region from each incident surface 24 to the opposite position 20C is divided into three regions of a first region 20D, a second region 20E, and a third region 20F in order of proximity to the incident surface 24. The sectional shape of the projection portion 25 in the first region 20D is a substantially triangular shape. The sectional shape of the projection portion 25 in the third region 20F is a substantially semicircular shape. The sectional shape of the projection portion 25 in the second region 20E is a shape resembling both of the projection portion 25 in the first region 20D and the projection portion 25 in the third region 20F.

The auxiliary lens portion 21 is provided so as to cover the slit portion 23 externally in the radial direction R. The auxiliary lens portion 21 is low-profile in the radial direction R, and extends in a belt shape in the axial direction X (refer to FIG. 10). The dimension of the auxiliary lens portion 21 in the axial direction X is slightly smaller than the dimension of the light guiding radiation portion 20 in the axial direction X (refer to FIG. 9 and FIG. 10). In the auxiliary lens portion 21, an outside surface 21A in the radial direction R and an inside surface 21B in the radial direction R are bulged in arc shapes in mutually separating directions. Therefore, the auxiliary lens portion 21 when cut along a cutting plane orthogonal to the axial direction X has a section whose thickness in the radial direction R is gradually reduced toward both outer sides in the circumferential direction P. End faces 21C at both sides in the circumferential direction P of the auxiliary lens portion 21 are flat surfaces that intersect each of the outside surface 21A and the inside surface 21B while extending along the axial direction X. The outside surface 21A constitutes a part of the exterior contour 3R of the lens unit 3.

In the inside surface 21B, at the center in the circumferential direction P, a pair of rail portions 26 extending in parallel along the axial direction X are integrally provided. The dimension of the respective rail portions 26 in the axial direction X is smaller than the dimension of the inside surface 21B in the axial direction X (refer to FIG. 11). The interval of the pair of rail portions 26 is substantially the same as the thickness (dimension in the thickness direction T) of the LED mounting substrate 2. Between the pair of rail portions 26, a movement restraining portion 27 (first movement restraining portion) is provided. The movement restraining portion 27 is in a groove shape that is open to the inside in the radial direction R in the inside surface 21B of the auxiliary lens portion 21, and extends in the axial direction X.

The lens unit 3 includes a coupling portion 29 that couples the light guiding radiation portion 20 and the auxiliary lens portion 21. The coupling portion 29 is in a plate shape that is thin in the axial direction X (refer to FIG. 9). The coupling portion 29 is arranged at a position slightly biased to the upper side from the center of the light guiding radiation portion 20 in the axial direction X (which is also the center of the lens unit 3 as a whole) (refer to FIG. 9 and FIG. 10). In the lens unit 3, the position of the coupling portion 29 in the axial direction X is a matching position (boundary) Y of two molds (not shown) when the lens unit 3 is molded in two molds (refer to FIG. 10). Because the matching position Y is off the center of the lens unit 3, when said two molds are separated after molding the lens unit 3, the lens unit 3 is always located in either set mold, which is thus convenient in the point of handling of the lens unit 3 after molding.

As seen from the axial direction X, the coupling portion 29 is disposed, on both lateral sides of the slit portion 23 and the movement restraining portion 27 in the circumferential direction P, between the outer peripheral surface 20A of the light guiding radiation portion 20 and each of the inside surface 21B and the end faces 21C of the auxiliary lens portion 21. An outer peripheral surface 29A of the coupling portion 29 in the radial direction R constitutes a part of the exterior contour 3R of the lens unit 3, and smoothly connects the outer peripheral surface 20A of the light guiding radiation portion 20 and the outside surface 21A of the auxiliary lens portion 21.

The support portion 22 is housed inside the light guiding radiation portion 20. The support portion 22 is in a cylindrical shape. In a strict sense, the support portion 22 is in a substantially circular cylindrical shape smaller in diameter than the light guiding radiation portion 20, and its central axis extends along the axial direction X. Also, the central axis (circle center) of the support portion 22 is not coincident with a central axis of the light guiding radiation portion 20 (in a strict sense, the exterior contour 3R of the lens unit 3), and is slightly shifted to the opposite position 20C side from the central axis of the light guiding radiation portion 20. The dimension of the support portion 22 in the axial direction X is greater than the dimension of the light guiding radiation portion 20 in the axial direction X. Therefore, one-end portion (upper end portion) 22C of the support portion 22 in the axial direction X is sticking out to the outside (upper side) further than the light guiding radiation portion 20, and the other-end portion (lower end portion) 22D of the support portion 22 in the axial direction X is sticking out to the outside (lower side) further than the light guiding radiation portion 20 (refer to FIG. 9 and FIG. 10). An upper end face of the support portion 22 will be referred to as one end-side abutting end face 22E provided at one end side in the axial direction X in the lens unit 3, and a lower end face of the support portion 22 will be referred to as the other end-side abutting end face 22F provided at the other end side in the axial direction X in the lens unit 3 (refer to FIG. 9 and FIG. 10). Both of the one end-side abutting end face 22E and the other end-side abutting end face 22F are flat along a direction orthogonal to the axial direction X.

At one spot on the circumference of the support portion 22, a slit portion 30 is defined. The slit portion 30 cuts away the support portion 22 in the axial direction X, and cuts one spot on the circumference of the support portion 22 along the axial direction X. Therefore, the support portion 22 when cut along a cutting plane orthogonal to the axial direction X has a section showing, in a strict sense, a substantially C shape that is broken at the slit portion 30. In terms of the circumferential direction P, the slit portion 30 and the slit portion 23 of the light guiding radiation portion 20 are in the same position. Therefore, the slit portion 30 and the slit portion 23 are located on an identical straight line (in detail, a straight line along a flat surface M to be described later) extending in the radial direction R.

The support portion 22 has an outer peripheral surface 22A and an inner peripheral surface 22B.

The outer peripheral surface 22A is applied with a light shielding processing across the entire circumference. Specifically, at the outer peripheral surface 22A, streak-shaped projection portions 31 extending along the axial direction X are provided, and the large number of projection portions 31 are arranged across the entire circumferential region of the outer peripheral surface 22A so as to be aligned in the circumferential direction of the outer peripheral surface 22A. Each projection portion 31 when cut along a cutting plane orthogonal to the axial direction X has a section showing a substantially triangular shape that is pointed to the outside. In addition, as another example of the light shielding processing in the outer peripheral surface 22A, surface texturing or the like may be applied to the outer peripheral surface 22A.

At the inner peripheral surface 22B, a plurality of (here, four) positioning ribs 32 are provided. The four positioning ribs 32 are arranged at equal intervals in the circumferential direction of the inner peripheral surface 22B. The closest positioning rib 32 to the slit portion 30 is at a position separated approximately 45 degrees in the circumferential direction of the inner peripheral surface 22B from the slit portion 30. Each positioning rib 32 is a quadrangular prism extending long and narrow in the axial direction X, and its distal end portion 32A (engaging portion, first coupling guide portion) is provided on one end side (the one end-side abutting end face 22E described above) of the lens unit 3 in the axial direction X, and in a strict sense, sticking out to the outside (upper side) further than the one end-side abutting end face 22E (refer to FIG. 6).

In addition, the light shielding processing described above may be applied to the inner peripheral surface 22B not to the outer peripheral surface 22A, or may be applied to both of the outer peripheral surface 22A and the inner peripheral surface 22B.

The lens unit 3 includes a coupling portion 33 that couples the light guiding radiation portion 20 and the support portion 22. The coupling portion 33 is in a thin plate shape that is the same in thickness as the coupling portion 29 described above, and is at the same position as that of the coupling portion 29 in the axial direction X. The coupling portion 33, in a view from the axial direction X, shows a substantially U shape that is open to the slit portion 23 side of the light guiding radiation portion 20. Such a coupling portion 33 is disposed between the inner peripheral surface 20B of the light guiding radiation portion 20 and the outer peripheral surface 22A of the support portion 22 so as to fill a space between the inner peripheral surface 20B (in a strict sense, the inner peripheral surface 20B in the second regions 20E and the third regions 20F described above) and the outer peripheral surface 22A. Because the coupling portion 33 is not connected to the inner peripheral surface 20B in the first regions 20D, a gap 34 is demarcated, in a view from the axial direction X, between the coupling portion 33 and the inner peripheral surface 20B in the first region 20D. The gap 34 is exposed to the outside from both sides of the lens unit 3 in the axial direction X (refer to FIG. 7 and FIG. 8).

Also, at the inner peripheral surface 22B of the support portion 22, a substantially circular shaped blocking portion 35 that occupies most of the region in a hollow part of the support portion 22 when viewed from the axial direction X, is provided. The blocking portion 35 is in a thin plate shape that is the same in thickness as each of the coupling portion 29 and the coupling portion 33, and is at the same position as that of each of the coupling portion 29 and the coupling portion 33 in the axial direction X. To an upper surface of the blocking portion 35, a base part (lower end portion at the side opposite to the distal end portion 32A) of each positioning rib 32 is connected (refer to FIG. 12 and FIG. 13).

In the blocking portion 35, a cut-away groove 36 extending linearly along the radial direction of the support portion 22 is defined continuously from the slit portion 30 of the support portion 22. The cut-away groove 36 penetrates through the blocking portion 35 in the thickness direction, while extending up to a position separated from the slit portion 30 further than the circle center of the blocking portion 35 (position on the opposite side to the slit portion 30 with respect to the circle center of the blocking portion 35). Of the part where the cut-away groove 36 is demarcated in the blocking portion 35, apart separated the most from the slit portion 23 (the groove bottom of the cut-away groove 36) will be referred to as a bottom surface 36A (second movement restraining portion). The direction in which the cut-away groove 36 extends from the slit portion 30 toward the bottom surface 36A in a view from the axial direction X will be referred to as a depth direction D, and the direction orthogonal to the depth direction D will be referred to as a width direction W. The bottom surface 36A is flat along the width direction W. The bottom surface 36A is provided on the side opposite to the auxiliary lens portion 21 (the opposite position 20C side of the light guiding radiation portion 20) in the depth direction D. The slit portion 23 and the slit portion 30 and the cut-away groove 36 are located on an identical straight line (the straight line along a flat surface M) described above.

As shown in FIG. 12 and FIG. 13, the lens unit 3 includes a pair of insertion space defining members 40 in the blocking portion 35. In addition, in FIG. 12 and FIG. 13, for the sake of convenience, dotted parts correspond to sections or end faces (not sections).

The pair of insertion space defining members 40 are in lever shapes extending along the axial direction X, and their respective substantially central parts in the axial direction X are coupled to the blocking portion 35.

Referring to FIG. 7, the pair of insertion space defining members 40 are arranged opposed to each other in the width direction W so as to sandwich a part at the side close to the bottom surface 36A of the cut-away groove 36 (in a strict sense, the circle center of the blocking portion 35) from the width direction W, in a view from the axial direction X. The pair of insertion space defining members 40 are arranged opposed to each other in a non-contact state. The blocking portion 35 and the coupling portion 33 (also including the parts connected to the blocking portion 35 and the coupling portion 33 in the support portion 22) couple the pair of insertion space defining members 40 and the light guiding radiation portion 20 (refer to FIG. 11). Each insertion space defining member 40 when viewed from the axial direction X shows an oblong shape having a long side in the depth direction D (that is low-profile in the width direction W).

The pair of insertion space defining members 40 demarcate, between each other's opposite faces 40A, a gap called an insertion space 41. The insertion space 41 is exposed to the outside from both sides of the lens unit 3 in the axial direction X (refer to FIG. 7 and FIG. 8). In a view from the axial direction X, the insertion space 41 is defined inside the support portion 22. The insertion space 41 when cut along a cutting plane orthogonal to the axial direction X has a section that is low-profile in the width direction W.

Referring to FIG. 9 to FIG. 11, one-end portions 40B (upper end portions) in the axial direction X of the pair of insertion space defining members 40 project to the outside (upper side) in the axial direction X further than the one end-side abutting end face 22E that is the upper surface of the support portion 22. The other-end portions 40C (lower end portions) in the axial direction X of the pair of insertion space defining members 40 slightly project to the outside (lower side) in the axial direction X further than the other end-side abutting end face 22F that is the lower surface of the support portion 22. That is, the one-end portions 40B project to the outside of the support portion 22 further than the other-end portions 40C.

Referring to FIG. 11, in an end portion at the other-end portion 40C side in the opposite face 40A of each insertion space defining member 40, an inclined surface 40D extending so as to be inclined in the axial direction X to chamfer said end portion is formed. In an end portion at the one-end portion 40B side in the opposite face 40A of each insertion space defining member 40, a flat surface 40E along the axial direction X is formed. At the upper end of the flat surface 40E, a projection portion 40F that is slightly projecting toward the other-side insertion space defining member 40 is provided. The dimension in the width direction W of the insertion space 41 is substantially the same as the dimension in the thickness direction T of the LED mounting substrate 2 (refer to FIG. 7). However, in a strict sense, the dimension in the width direction W of the insertion space 41 in a state where the lens unit 3 exists alone (a state where the lens unit 3 is not coupled to another lens unit 3) is slightly greater than the dimension in the thickness direction T of the LED mounting substrate 2. Also, the dimension in the width direction W of the insertion space 41 is narrower at the one-end portion 40B side than at the other-end portion 40C side. At an outer surface in the one-end portion 40B of each insertion space defining member 40 (a surface at the side opposite to the opposite face 40A), a recess 40G that narrows the one-end portion 40B (part at the projection portion 40F side) stepwise is defined.

Referring to FIG. 8, in connection with the respective insertion space defining members 40, the lens unit 3 includes reinforcing portions 42. The reinforcing portions 42 are provided one each for the insertion space defining members 40. The respective reinforcing portions 42 are plate shapes that are thin in the long-side direction (depth direction D) of the insertion space defining member 40 when viewed from the axial direction X, and extend in the axial direction X (refer to FIG. 5A). In addition, for the sake of convenience, illustration of the reinforcing portions 42 is omitted in some figures.

Referring to FIG. 11, the respective reinforcing portions 42 show triangular shapes that are each coupled to both of the other-end portion 40C of the corresponding insertion space defining member 40 (which is, in a strict sense, a substantially central position in the depth direction D of a part on the other-end portion 40C side further than the blocking portion 35, refer to FIG. 8) and the blocking portion 35. The reinforcing portions 42 reinforce the other-end portions 40C in the axial direction X of the pair of insertion space defining members 40. Therefore, the other-end portions 40C of the respective insertion space defining members 40 are made unlikely to warp (made unlikely to swing) about the coupling positions (sometimes referred to fulcrum positions Q) with the blocking portion 35. On the other hand, the one-end portions 40B in the axial direction X of the pair of insertion space defining members 40 are not reinforced, and are thus elastically deformable so as to swing about the fulcrum positions Q (coupling positions with the blocking portion 35).

Such a lens unit 3 as above is, in a view from the axial direction X as shown in FIG. 7 and FIG. 8, in a shape that is symmetrical based on a flat surface M passing through the slit portion 23, the slit portion 30, and the cut-away groove 36 and the circle center of the lens unit 3.

When assembling the lens units 3, the plurality of (here, five) lens units 3 are aligned along the vertical direction with their respective axial directions X being in parallel (refer to FIG. 3A, FIG. 4A, and FIG. 5A).

Coupling of adjacent lens units 3 will be described while referring to FIG. 14A and FIG. 14B.

Figure 14A:
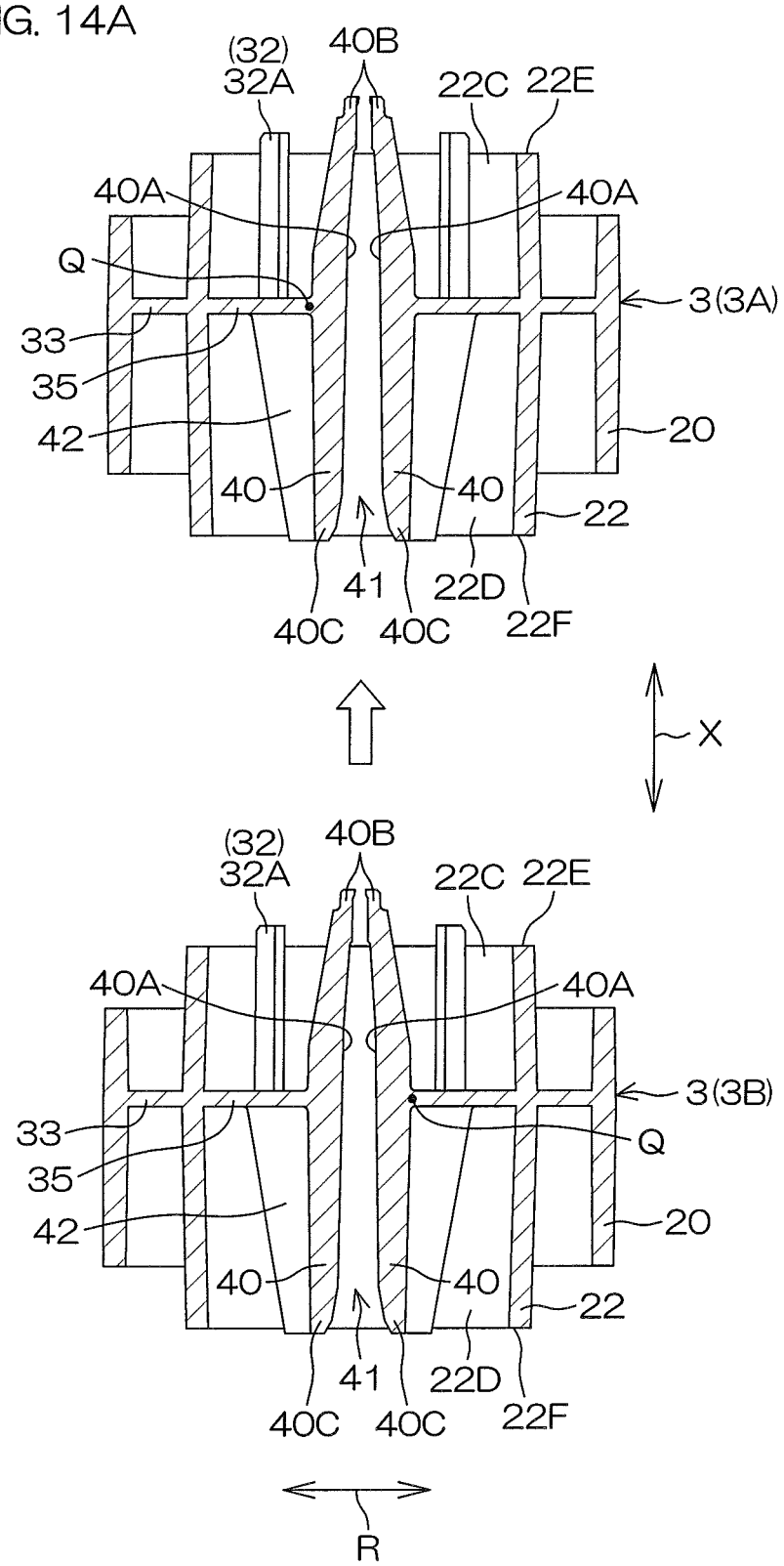
FIG. 14A is a sectional view of two lens units 3 to be coupled.

In the two lens units 3 adjacent as shown in FIG. 14A, as an example, the one end-side abutting end face 22E of the support portion 22 of the second lens unit 3B on the lower side in FIG. 14A is opposed from the axial direction X with respect to the other end-side abutting end face 22F of the support portion 22 of another lens unit 3 (the first lens unit 3A) present on the upper side in FIG. 14A. From this state, as shown by an outline arrow in FIG. 14A, the second lens unit 3B is made proximate to the first lens unit 3A. Conversely, the first lens unit 3A may be made proximate to the second lens unit 3B.

Figure 14B:
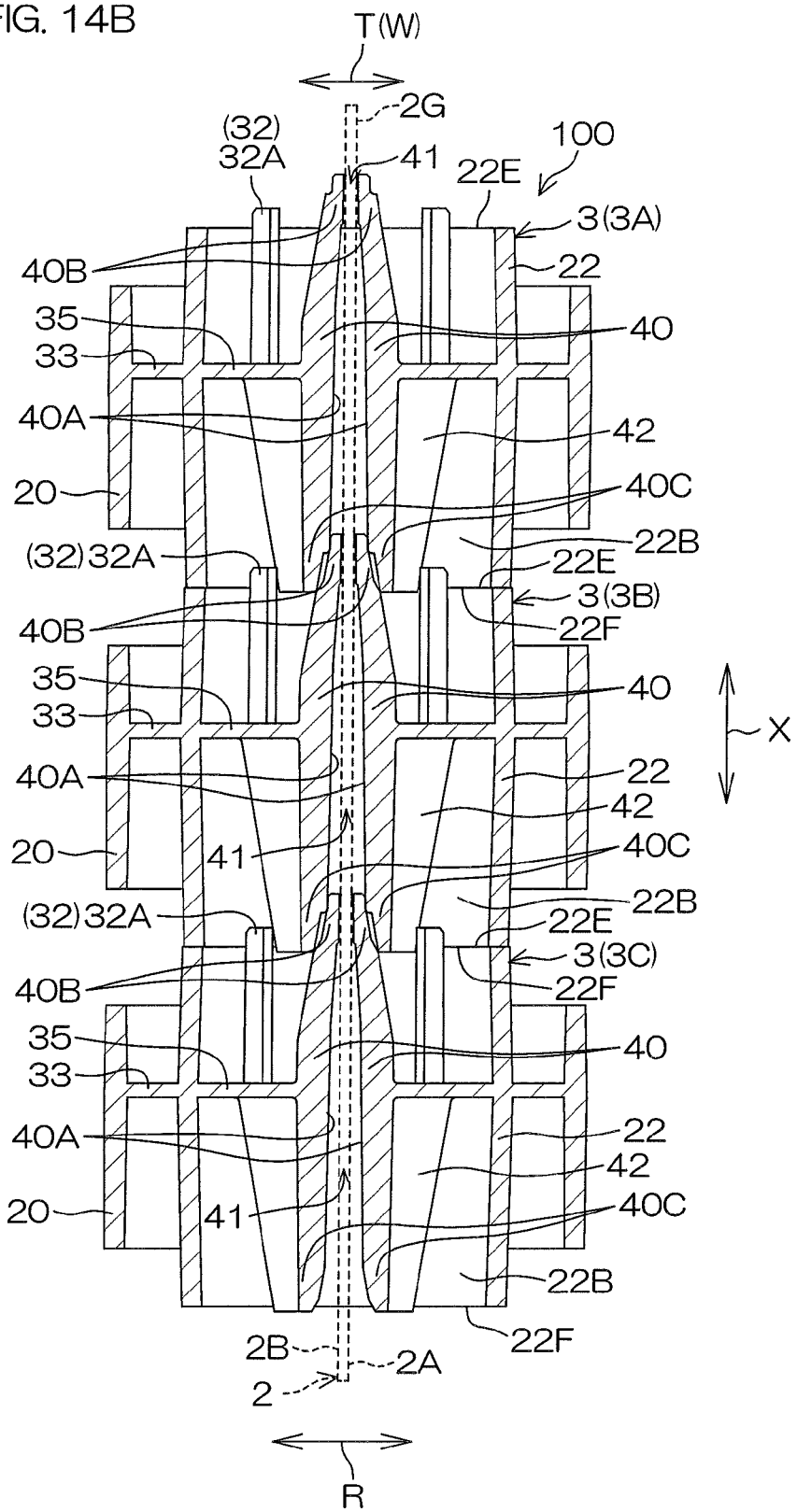
FIG. 14B is a sectional view of three coupled lens units 3.

In either case, with the approximation of the first lens unit 3A and the second lens unit 3B, as shown in FIG. 14B, the one-end portions 40B of the pair of insertion space defining members 40 in the second lens unit 3B enter between the other-end portions 40C in the axial direction X of the pair of insertion space defining members 40 in the first lens unit 3A. Accordingly, said one-end portions 40B become proximate to each other. Then, when the one end-side abutting end face 22E of the support portion 22 of the second lens unit 3B abuts against (makes surface contact with) the other end side (the other end-side abutting end face 22F of the support portion 22) of the first lens unit 3A as shown in FIG. 14B, coupling of these lens units 3 with each other is completed. At this time, the distal end portions 32A of the respective positioning ribs 32 inside the support portion 22 of the second lens unit 3B are in engagement with the other end side (the inner peripheral surface 22B of the support portion 22) of the first lens unit 3A coupled therewith. When the second lens unit 3B and the third lens unit 3C are similarly coupled, the other end-side abutting end face 22F of the second lens unit 3B abuts against (makes surface contact with) the one end side (the one end-side abutting end face 22E) of the third lens unit 3C (another lens unit 3 coupled therewith) as shown in FIG. 14B. Also, the distal end portions 32A of the positioning ribs 32 of the third lens unit 3C are engaged with the other end side of the second lens unit 3B. Thus, the adjacent lens units 3 can be coupled, by the distal end portions 32A of the respective positioning ribs 32, in a state of being fixed in relative position. Also, the one end-side abutting end face 22E and the other end-side abutting end face 22F that are flat abut against the support portion 22 of the other-side lens unit 3 (corresponding one of the one end-side abutting end face 22E and the other end-side abutting end face 22F). Thereby, the support portion 22 of each lens unit 3 supports (positions) another lens unit 3 coupled therewith, from the axial direction X. That is, the support portion 22 can stabilize relative positions of the adjacently coupled lens units 3 to each other. At this time, the adjacent lens units 3 are coaxial and in parallel.

Then, finally, the lens units 3 adjacent in the first lens unit 3A to the fifth lens unit 3E are coupled to each other by the similar procedure to integrate the five lens units 3 to be linked together, as shown in FIG. 2. In the five lens units 3 thus integrated, the insertion spaces 41 demarcated between the pair of insertion space defining members 40 (five insertion spaces 41 exist in response to the five lens units 3) are aligned on an identical straight line extending in the axial direction X, and communicate with each other.

In this state, the LED mounting substrate 2 with its long-side direction L being coincident (made parallel) with the axial direction X is inserted into the insertion spaces 41 of the respective lens units 3, and at least apart of the LED mounting substrate 2 is enclosed (housed) in the insertion spaces 41 of the respective lens units 3. When the relative positions of the LED mounting substrate 2 and the respective lens units 3 are appropriate (finally determined), as shown in FIG. 7, the LED mounting substrate 2 is inserted in the slit portion 23, the slit portion 30, and the cut-away groove 36 in a posture along the flat surface M described above. At this time, not only are the long-side direction L and the axial direction X coincident, but the short-side direction S of the LED mounting substrate 2 enclosed in the respective lens units 3 and the depth direction D described above are also coincident, and the thickness direction T of the LED mounting substrate 2 and the width direction W described above are coincident.

Also, in this state, as shown in FIG. 2, the first set 15A of the LEDs 14 and the first lens unit 3A are at the same position in the long-side direction L. Also, in the long-side direction L, the second set 15B of the LEDs 14 and the second lens unit 3B are at the same position, the third set 15C and the third lens unit 3C are at the same position, the fourth set 15D and the fourth lens unit 3D are at the same position, and the fifth set 15E and the fifth lens unit 3E are at the same position.

All LEDs 14 in each set 15 are, as shown in FIG. 7, arranged within the slit portion 23 of the light guiding radiation portion 20 in the corresponding lens unit 3 (located at the same position in the long-side direction L). In the LED mounting substrate 2, the respective LEDs 14 on the front surface 2A are arranged opposed across a gap with respect to one (here, the incident surface 24A) of the pair of incident surfaces 24 described above, and the respective LEDs 14 on the back surface 2B are arranged opposed across a gap with respect to the other (here, the incident surface 24B) of the pair of incident surfaces 24.

Also, in this state, the end portion 2D (in the short-side direction S) at the side where the LEDs 14 are located in the LED mounting substrate 2, in each lens unit 3, sticks out of the support portion 22 and the light guiding radiation portion 20, is fitted into the movement restraining portion 27 (groove between the pair of rail portions 26) of the auxiliary lens portion 21, and is sandwiched by the pair of rail portions 26. Also, the end portion 2D abuts from the short-side direction S against the auxiliary lens portion 21 within the movement restraining portion 27. A movement in each of the short-side direction S (in a strict sense, the side of the auxiliary lens portion 21) and the thickness direction T of the LED mounting substrate 2 is thereby restrained. The relative positions of the respective lens units 3 and the LEDs 14 located at the corresponding positions in the LED mounting substrate 2 can thereby be stabilized.

On the other side, an end portion 2F at the side opposite to the end portion 2D in the short-side direction S of the LED mounting substrate 2 abuts from the short-side direction S against the bottom surface 36A of the cut-away groove 36 in the blocking portion 35 of the lens unit 3. A movement of the LED mounting substrate 2 in the short-side direction S (in a strict sense, the side opposite to the auxiliary lens portion 21 side) is thereby restrained. Thus, the relative positions of the respective lens units 3 and the LEDs 14 located at the corresponding positions in the LED mounting substrate 2 can be further stabilized. In addition, in the LED mounting substrate 2, a part at the side of the end portion 2F further than the end portion 2D in the short-side direction S is enclosed in the support portion 22.

When the respective LEDs 14 of the LED mounting substrate 2 emit light, light radiated from the respective LEDs 14 (LED radiation light) is made incident into the light guiding radiation portion 20 of the lens unit 3 from the incident surfaces 24 arranged opposed to the LEDs 14. Specifically, in the LED mounting substrate 2, light from the respective LEDs 14 on the front surface 2A is made incident into the light guiding radiation portion 20 from the incident surface 24A, and light from the respective LEDs 14 on the back surface 2B is made incident into the light guiding radiation portion 20 from the incident surface 24B. The light made incident into the light guiding radiation portion 20 from the respective incident surfaces 24 proceeds inside the light guiding radiation portion 20 along the circumferential direction P, and in doing so, is radiated outward (outside in the radial direction R) from the light guiding radiation portion 20 over the entire region in the circumferential direction P of the light guiding radiation portion 20. That is, the light made incident into the light guiding radiation portion 20 from the incident surfaces 24 is guided by the light guiding radiation portion 20, and is radiated outward in the entire circumferential region (entire region in the circumferential direction P) of the light guiding radiation portion 20.

As a detailed description of the motion of light in the light guiding radiation portion 20, light is, in the first region 20D, easily radiated relatively outward by the projection portions 25 in the first region 20D. In the second region 20E, a part of the light is sometimes radiated to the inside of the light guiding radiation portion 20, but said part of the light is diffusely reflected by the projection portions 25 in the third region 20F, and is finally radiated outward.

On the other hand, light having leaked from the slit portion 23 of the light guiding radiation portion 20 is transferred to the auxiliary lens portion 21, and radiated outward by the auxiliary lens portion 21. Also, onto the auxiliary lens portion 21 and its inside surface 21B, out of the direct radiating light of the LEDs 14, light that has not been made incident onto the light guiding radiation portion 20 via the incident surfaces 24 is irradiated. The auxiliary lens portion 21 and the inside surface 21B reflect the direct irradiating light from the LEDs 14 in a manner of being made incident onto the light guiding radiation portion 20 from the outer peripheral surface 20A. Also, the auxiliary lens portion 21 and the inside surface 21B radiate the direct irradiating light from the LEDs 14 from its own outside surface 21A and end faces 21C. Accordingly, in the respective lens units 3, throughout the entire circumference in the circumferential direction P, signal notice that is unlikely to cause a change in visibility in the circumferential direction P can be performed.

As a result of the above, in the respective lens units 3, light is almost uniformly irradiated over the entire region in the circumferential direction P.

In this connection, external light sometimes enters the respective lens units 3. When said light is transmitted through the light guiding radiation portion 20 to proceed to inside of the light guiding radiation portion 20, this light is diffusely reflected by the outer peripheral surface 22A (projection portions 31) applied with a light shielding processing in the support portion 22. The external light is thereby weakened. Also, an adverse effect on radiation characteristics of light in the light guiding radiation portion 20 caused by light leaked to the inside of the light guiding radiation portion 20 being transmitted through the support portion 22 and then being made incident onto the light guiding radiation portion 20 can also be prevented by said projection portions 31. As a result of these, light to be radiated to the outside from the light guiding radiation portion 20 can be emphasized. In addition, the support portion 22 applied at the outer peripheral surface 22A with a light-shielding processing can also function as a screen for the LED mounting substrate 2 located inside thereof. Similarly, the auxiliary lens unit 21 also serves the role of screening the part (end portion 2D) exposed from the slit portion 23 of the light guiding radiation portion 20 in the LED mounting substrate 2.

Also, referring to FIG. 14B, in each one lens unit 3 other than the first lens unit 3A, as described above, the one-end portions 40B of the pair of insertion space defining members 40 are proximate to each other as a result of entering between the other-end portions 40C of the pair of insertion space defining members 40 in another lens unit 3 coupled therewith. The dimension (in the width direction W) of the insertion space 41 between said one-end portions 40B is smaller than the dimension in the thickness direction T of the LED mounting substrate 2. Therefore, said one-end portions 40B (which are, particularly, the flat surfaces 40E and the projection portions 40F described above, refer to FIG. 11) sandwich the LED mounting substrate 2 (the part at the end portion 2F side away from the LEDs 14) in the thickness direction T with a predetermined pressure or more (refer also to FIG. 7).

That is, in the signal indicator lamp 1, when a plurality of lens units 3 are coupled in the axial direction X, in the respective lens units 3, the one-end portions 40B of the pair of insertion space defining members 40 strongly sandwich the LED mounting substrate 2 in the thickness direction T. The relative positions of the respective lens units 3 and the LEDs 14 located at the corresponding positions (the same positions in the long-side direction L) in the LED mounting substrate 2 can thereby be stabilized. Also, by the movement restraining portion 27 and the bottom surface 36A of the cut-away groove 36 shown in FIG. 7, the relative positions of the respective lens units 3 and the LEDs 14 located at the corresponding positions in the LED mounting substrate 2 can be further stabilized. Thus, consequently, in the signal indicator lamp 1, light from the LEDs 14 can be stably guided to the lens units 3 for irradiation even if there is vibration.

Also, as described above, for each lens unit 3, in the slit portion 23 of the light guiding radiation portion 20, the LEDs 14 mounted at positions biased to the end portion 2D side in the short-side direction S of the LED mounting substrate 2 are arranged. The pair of opposite end faces of the slit portion 23 in the light guiding radiation portion 20 serve as incident surfaces 24, and light made incident into the lens unit 3 from the incident surfaces 24 is guided by the light guiding radiation portion 20, and is radiated outward in the entire circumferential region thereof. With such an arrangement, in the signal indicator lamp 1, the LED mounting substrate 2 and the lens unit 3 can be arranged in a manner of being put together compactly so as to be as proximate as possible to each other. That is, a signal indicator lamp 1 with a new structure that leads to downsizing and simplification can be provided.

In the following, as shown in FIG. 2 and FIG. 14, the plurality of (finally, five) coupled lens units 3 and the LED mounting substrate 2 sandwiched by the one-end portions 40B of the pair of insertion space defining members 40 of each lens unit 3 will be referred to as an assembly 100. In addition, in the assembling procedure for the assembly 100 described in the foregoing, the lens units 3 are coupled first, and the LED mounting substrate 2 is then inserted into the insertion spaces 41 of the respective lens units 3. In place of this procedure, the assembly 100 may be assembled by inserting the LED mounting substrate 2 in advance into the insertion spaces 41 of a plurality of lens units 3 aligned in a non-coupled state and then coupling the adjacent lens units 3.

Next, description will be given of arrangements other than those of the LED mounting substrate 2 and the lens unit 3.

Referring to FIG. 3B, FIG. 4B, and FIG. 5B, the body 4 is in a hollow circular cylindrical shape to house a lower part where no LEDs 14 are mounted in the LED mounting substrate 2, and its central axis extends in the vertical direction. The hollow part of the body 4 is exposed from both upper and lower sides. At an inner peripheral surface of the body 4, a plurality of (here, two) boss portions 50 that extend vertically are formed. These boss portions 50 are arranged at an interval in the circumferential direction of the inner peripheral surface of the body 4. In each boss portion 50, a screw hole 50A that extends vertically is defined (refer to FIG. 4B and FIG. 5B).

The plate 5 is in a substantially disk shape that is vertically thin, and at one spot on its circumference, a concave cut-away 5A that is recessed to the circle center side of the plate 5 while penetrating through the plate 5 in the thickness direction is defined. At positions away from the cut-away 5A in the plate 5, a plurality of (here, two) through-holes 5B are defined. These through-holes 5B are circular holes that penetrate through the plate 5 in the thickness direction, and are arranged at an interval in the circumferential direction of the plate 5. In an upper surface of the plate 5, at a circle center position of the plate 5, a support portion 51 (second support portion) is attached. The support portion 51 is in a substantially rectangular parallelepiped block shape. In the support portion 51, at least a part includes an elastic member such as rubber or sponge, and the support portion 51 is elastically deformable. The plate 5 is, with the plate 5 itself being horizontal and the support portion 51 facing up, housed in the body 4 from below. Through each through-hole 5B of the support portion 51, a screw (not shown) is inserted from below, and the screw is assembled into the screw hole 50A (refer to FIG. 5B) of the corresponding boss portion 50 in the body 4. The plate 5 is thereby fixed to the body 4.

The bracket 6 is in a hollow circular cylindrical shape, and its central axis extends in the vertical direction. At the lower end of the bracket 6, a disk-shaped bottom wall 6A is integrally provided, and the hollow part of the bracket 6 is covered from below by the bottom wall 6A. In the bottom wall 6A, a plurality of (here, three) through-holes 6B are defined. These through-holes 6B are circular holes that penetrate through the bottom wall 6A in the thickness direction, and are arranged at intervals in the circumferential direction of the bottom wall 6A. At parts that overlap the respective through-holes 6B in an upper surface of the bottom wall 6A, nuts 52 are fixed one each. A hollow part (part that is threaded) of the nut 52 and the through-hole 6A thereunder are communicated with each other. At a position away from the through-holes 6B in the bottom wall 6A, a through-hole 6C that penetrates through the bottom wall 6A in the thickness direction is defined. The through-hole 6C shows a substantially rectangular shape larger than the through-hole 6B (refer to FIG. 5B). As a result of an upper part of the bracket 6 being fitted into the body 4 from below, the bracket 6 is fixed with respect to the body 4. When the signal indicator lamp 1 is fixed to a mount (not shown) or the like, by assembling a screw (not shown) on the mount side passed through each through-hole 6B into the nut 52, the signal indicator lamp 1 as a whole is fixed with respect to the mount.

The waterproof ring 7 is a rubber packing formed with a ring shape, and is externally fitted to an upper end portion of an outer peripheral surface of the bracket 6. In a strict sense, at the upper end portion of the outer peripheral surface of the bracket 6, an annular groove 6D extending along said outer peripheral surface is defined, and the waterproof ring 7 is set on the annular groove 6D. The waterproof ring 7 provides sealing between the upper end portion of the bracket 6 and a lower end portion of the inner peripheral surface of the body 4 (refer to FIG. 2). Thereby, entry of water into the bracket 6 and the body 4 through a space between the upper end portion of the bracket 6 and the inner peripheral surface of the body 4 is prevented.

The waterproof sheet 8 is in a disk shape formed of a sheet of an elastic body such as rubber. In the waterproof sheet 8, a through-hole 8A and a through-hole 8B that penetrate through the waterproof sheet 8 in the thickness direction are defined. The through-hole 8B is in a substantially semicircular shape, and is larger than the through-hole 8A. The waterproof sheet 8 is attached to a lower surface of the bottom wall 6A of the bracket 6. In a strict sense, on the lower surface of the bottom wall 6A, a recess 6E that surrounds the respective through-holes 6B and the through-hole 6C while being shallowly recessed to the upper side is defined (refer to FIG. 5B), and in the waterproof sheet 8, a part thereof is housed in the recess 6E, while at least a lower end portion thereof is sticking out to the lower side from the recess 6E (refer to FIG. 1 and FIG. 2). From the through-hole 8A, one through-hole 6B in the bottom wall 6A of the bracket 6 is exposed downward, and from the through-hole 8B, the remaining two through-holes 6B and the through-hole 6C are exposed downward (refer to FIG. 5B). The waterproof sheet 8 serves the role of providing sealing between the mount (not shown) described above and the bottom wall 6A of the bracket 6. Thereby, entry of water into the bracket 6 through a space between the mount and the bottom wall 6A is prevented.

The waterproof ring 9 is a ring-shaped packing made of rubber or the like, and is externally fitted to an upper end portion of an outer peripheral surface of the body 4. In a strict sense, at the upper end portion of the outer peripheral surface of the body 4, an annular groove 4A extending along said outer peripheral surface is defined, and the waterproof ring 9 is engaged with the annular groove 4A, while bordering the upper end edge of the body 4 across the entire circumference (refer to FIG. 2).

The body 4, the plate 5, the bracket 6, the waterproof ring 7, the waterproof sheet 8, and the waterproof ring 9 described in the foregoing constitute a base portion 60.

Referring to FIG. 5A, the outer lens 10 is in a hollow circular cylindrical shape to house the five coupled lens units 3, and its central axis extends in the vertical direction. The outer lens 10 is made of a transparent resin (for example, polycarbonate) having impact resistance and transparency. The hollow part of the outer lens 10 is exposed from both upper and lower sides. As a result of the upper end portion of the body 4 being fitted into the outer lens 10 from below (refer to FIG. 5B), the body 4 is fixed with respect to the outer lens 10 (refer to FIG. 2). Thereby, the outer lens 10 is supported by the body 4 (that is, the base portion 60 described above). The waterproof ring 9 described above provides sealing between the upper end portion of the body 4 and a lower end portion of the outer lens 10 (refer to FIG. 2). Thereby, entry of water into the body 4 and the outer lens 10 through a space between the body 4 and the outer lens 10 is prevented.

The outer top 11 is in a disk shape, and in the entire region of its outer peripheral edge, a flange portion 11A bulging downward is integrally provided. The flange portion 11A shows a ring shape that borders the outer peripheral edge of the outer top 11. In a substantially circle center position of a lower surface of the outer top 11, a pair of sandwiching projections 53 (first support portions) that project downward are provided. The pair of sandwiching projections 53 have substantially the same arrangement as that of the other-end portions 40C of the pair of insertion space defining members 40 in each lens unit 3. For the outer top 11, reinforcing portions 54 are provided. The reinforcing portions 54 have a similar arrangement to that of the reinforcing portions 42 described above, and are provided for each of the sandwiching projections 53, and reinforce the corresponding sandwiching projections 53. The outer top 11 is assembled to an upper end portion of the outer lens 10 such that the flange portion 11A is externally fitted to the upper end portion of the outer lens 10. The outer top 11 is thereby integrated with the outer lens 10, so that the hollow part of the outer lens 10 is covered from above by the outer top 11 (refer to FIG. 2). With the outer top 11 in this state, the pair of sandwiching projections 53 advance into the hollow part of the outer lens 10 from above (refer to FIG. 2).

The waterproof cap 12 is a ring-shaped packing made of rubber or the like, and provides sealing between the flange portion 11A of the outer top 11 and the upper end portion of the outer lens 10. Thereby, entry of water into the outer lens 10 and the outer top 11 through a space between the outer top 11 and the upper end portion of the outer lens 10 is prevented (FIG. 2).

The head cover 13 is in a circular cap shape, and is assembled onto the outer top 11 from above so as to cover an upper surface of the outer top 11.

Here, each of the assembling between the body 4 and the bracket 6, assembling between the body 4 and the outer lens 10, assembling between the outer lens 10 and the outer top 11, and assembling between the outer top 11 and the head cover 13 may be assembling by press fitting, or may be assembling by threaded connection. In the present preferred embodiment, threaded connection is adopted, and in one of the two components to be combined, a convex rib 70 extending in the peripheral direction of the signal indicator lamp 1 (which is the same as the peripheral direction P described above) is defined, and in the other of said two components, a groove 71 to accept the rib 70 is defined (refer to FIG. 3A to FIG. 5B).

Referring to FIG. 2, the assembly 100 (the five lens units 3 coupled in the axial direction X and the LED mounting substrate 2) described above is stored in the outer lens 10. In the uppermost first lens unit 3A, the one-end portions 40B of the pair of insertion space defining members 40 are proximate to each other as a result of entering between the pair of sandwiching projections 53 in the outer top 11, and sandwich an upper end portion (one-end portion in the long-side direction) 2G of the LED mounting substrate 2 from the thickness direction T. At this time, the pair of sandwiching projections 53, via said one-end portions 40B, directly or indirectly support the first lens unit 3A (coupled to another lens unit 3) or the upper end portion 2G of the LED mounting substrate 2.

The lower part where no LEDs 14 are mounted in the LED mounting substrate 2 is housed in the body 4 as described above, and contacts the support portion 51 on the upper surface of the plate 5 in the body 4 from above. The support portion 51 is elastically deformable as described above, and thus supports a lower end portion 2H (the other-end portion in the long-side direction L) of the LED mounting substrate 2 in a manner of energizing upward. Thereby, the five lens units 3 and the LED mounting substrate 2 (that is, the assembly 100 as a whole) are pressed against the sandwiching projections 53 of the outer top 11 from the lower side. Therefore, the sandwiching projections 53 and the support portion 51 can hold the whole of the LED mounting substrate 2 and the plurality of lens units 3 so as not to cause rattling. Thus, in the signal indicator lamp 1, light from the LEDs 14 can be further stably guided to the lens units 3 for irradiation even if there is vibration.

As above, one end side in the long-side direction L of the LED mounting substrate 2 (the lens unit 3 on said one end side or the one-end portion (upper end portion 2G) of the LED mounting substrate 2) is supported by the sandwiching projections 53 on the outer lens 10 side, and the other-end portion (lower end portion 2H) in the long-side direction L of the LED mounting substrate 2 is supported by the support portion 51 of the base portion 60. Moreover, by the outer lens 10 being coupled to the base portion 60, the five lens units 3 as a whole are fixed to both of the outer lens 10 and the base portion 60. Thereby, in the signal indicator lamp 1, each of the lens units 3 and the LED mounting substrate 2 can be held. Thus, in the signal indicator lamp 1, light from the LEDs 14 can be further stably guided to the lens units 3 for irradiation even if there is vibration. In this connection, light radiated from the respective lens units 3 is irradiated, through the outer lens 10, to the outside from the entire circumferential region of the signal indicator light 1.

In addition, the waterproof ring 9 located at the upper end portion of the body 4 may abut against the lowermost fifth lens unit 3E from below to contribute to support of the assembly 100.

Referring to FIG. 4B, the cable 17 connected to the terminal 16 of the LED mounting substrate 2 is led out to the outside of the signal indicator light 1 through the cut-away 5A of the plate 5, the through-hole 6C of the bracket 6, and the through-hole 8B of the waterproof sheet 8, and is connected to an external power supply.

The present invention is not limited to the preferred embodiment described in the foregoing, and can be variously modified within the scope of the claims.

For example, referring to FIG. 14B, in the two coupled lens units 3 (refer to the second lens unit 3B and the third lens unit 3C), the distal end portions 32A of the respective positioning ribs 32 in one lens unit 3 (the third lens unit 3C) are engaged with the other end side (inner peripheral surface 22B at the other end-side abutting end face 22F side) of the support portion 22 in the other lens unit 3 (the second lens unit 3B). Here, it is preferable that the same number of (here, four) recess portions 90 (second coupling guide portions) to accept the distal end portions 32A of the respective positioning ribs 32 as the number of positioning ribs 32 are provided on the other end side in the axial direction X of the other lens unit 3 (refer to FIG. 13). By the distal end portions 32A being engaged one each with the respective recess portions 90, a rotation of the respective lens units 3 (each of the two coupled lens unit 3) (twisting of adjacent lens units 3) about a rotation axis (not shown) along the axial direction X can be restrained. Thereby, application of load due to said twisting to the LED mounting substrate 2 enclosed in the insertion spaces 41 of the respective lens units 3 can be suppressed.

In addition, as a reverse arrangement, recess portions 90 may be provided in said one lens unit 3 in place of the distal end portions 32A of the respective positioning ribs 32, and distal end portions 32A of respective positioning ribs 32 may be provided on the other end side of said the other lens unit 3.

Also, in each lens unit 3 other than the first lens unit 3A, as described above, the one-end portions 40B of the pair of insertion space defining members 40 become proximate to each other due to elastic deformation as a result of entering between the other-end portions 40C of the pair of insertion space defining members 40 in another lens unit 3 to be coupled. In the case of FIG. 14A and FIG. 14B, said the other-end portions 40C are reinforced by the reinforcing portions 42 to become unlikely to warp. In this case, said one-end portions 40B, when entering between the other-end portions 40C in the axial direction X of the pair of insertion space defining members 40 of another lens unit 3 to be coupled, enter between said the other-end portions 40C reinforced by the reinforcing portions 42. Therefore, said one-end portions 40B can be reliably elastically deformed to become proximate to each other, and sandwich the LED mounting substrate 2 in the thickness direction T (refer to FIG. 14B).

Figure 15A:
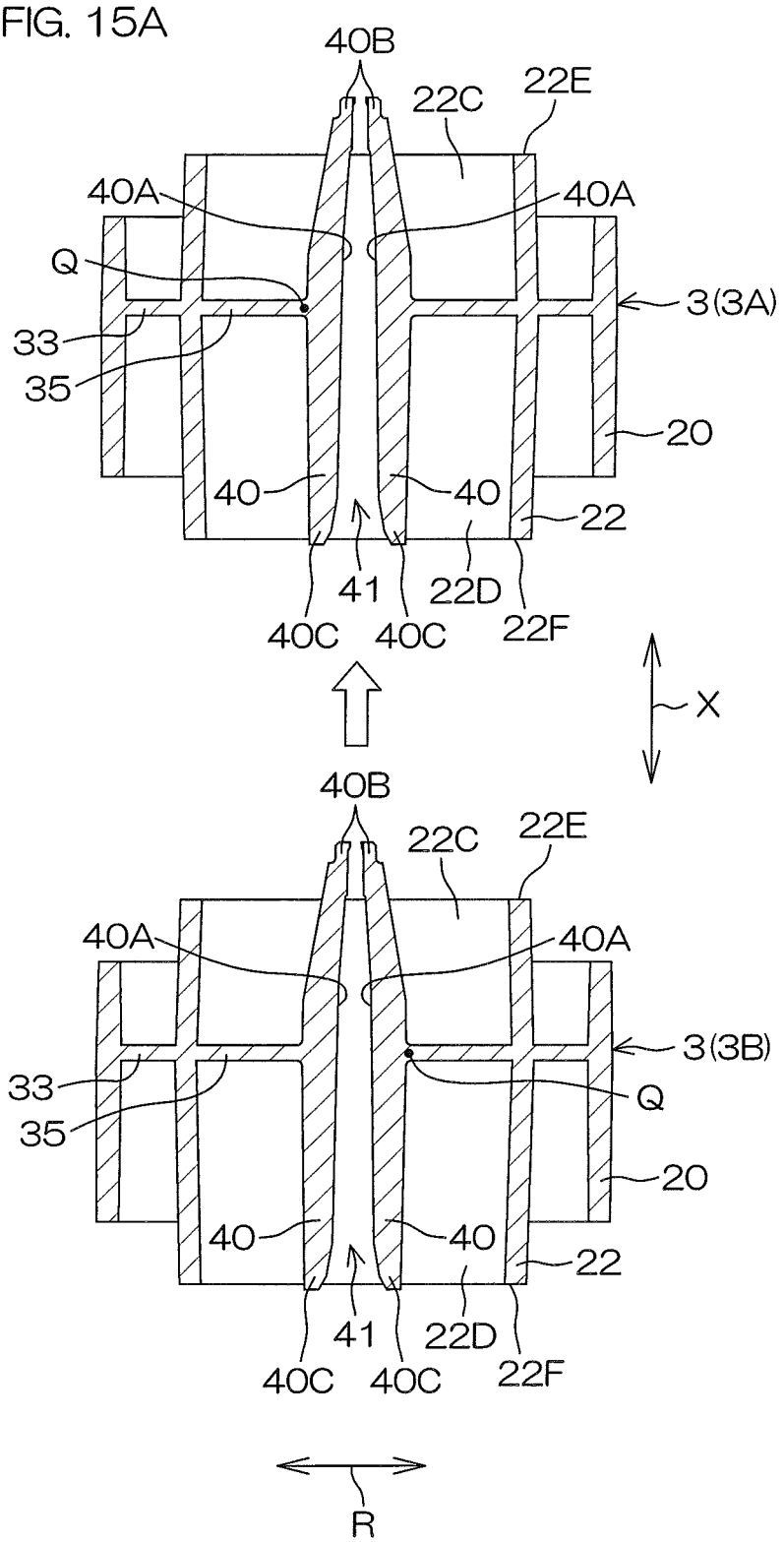
FIG. 15A relates to a first modification, and is a sectional view of two lens units 3 to be coupled.
Figure 15B:
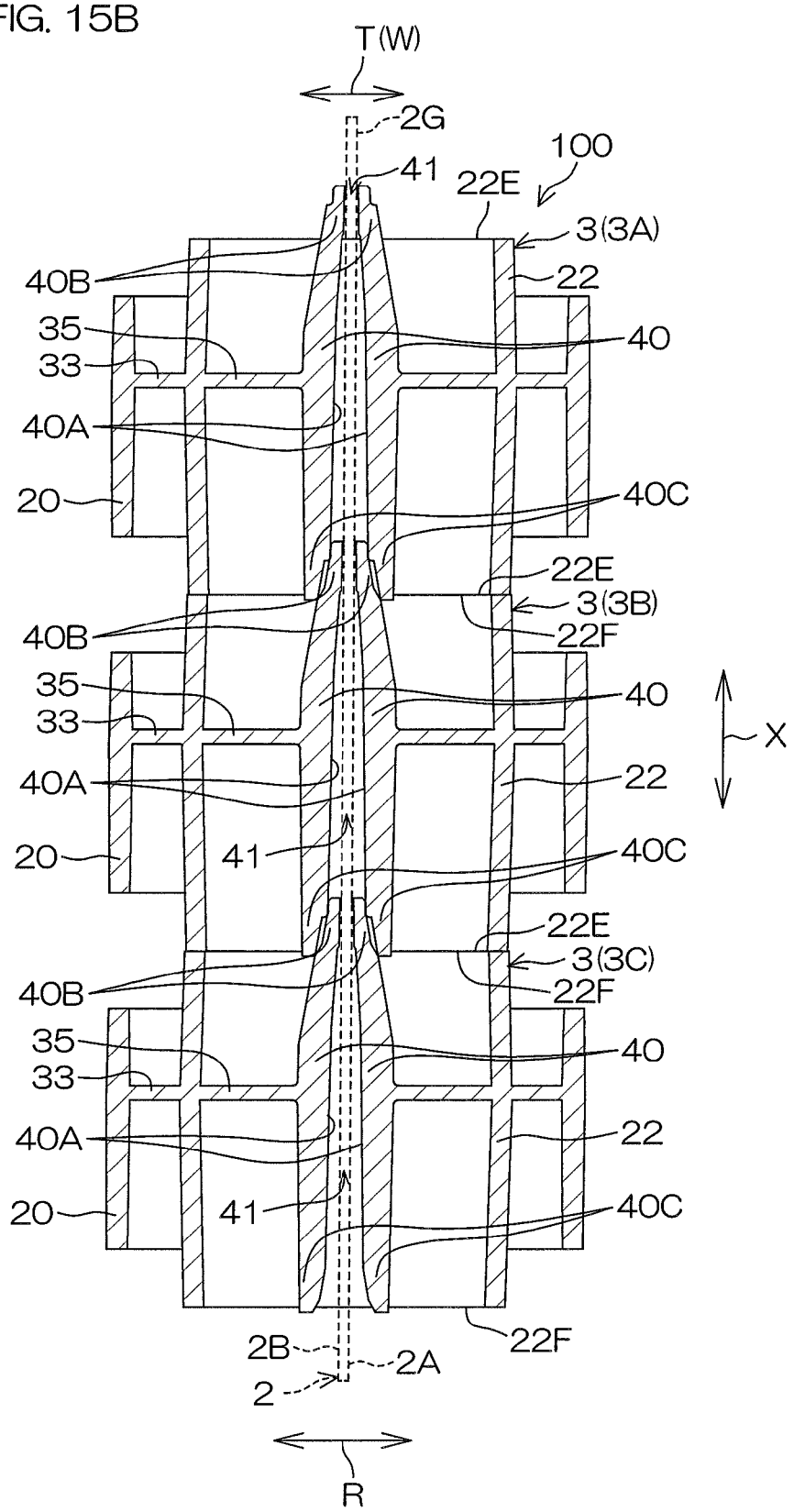
FIG. 15B relates to the first modification, and is a sectional view of three coupled lens units 3.

However, if said the other-end portions 40C themselves have sufficient rigidity, as shown in FIG. 15A and FIG. 15B, the reinforcing portions 42 may be omitted.

Figure 16A:
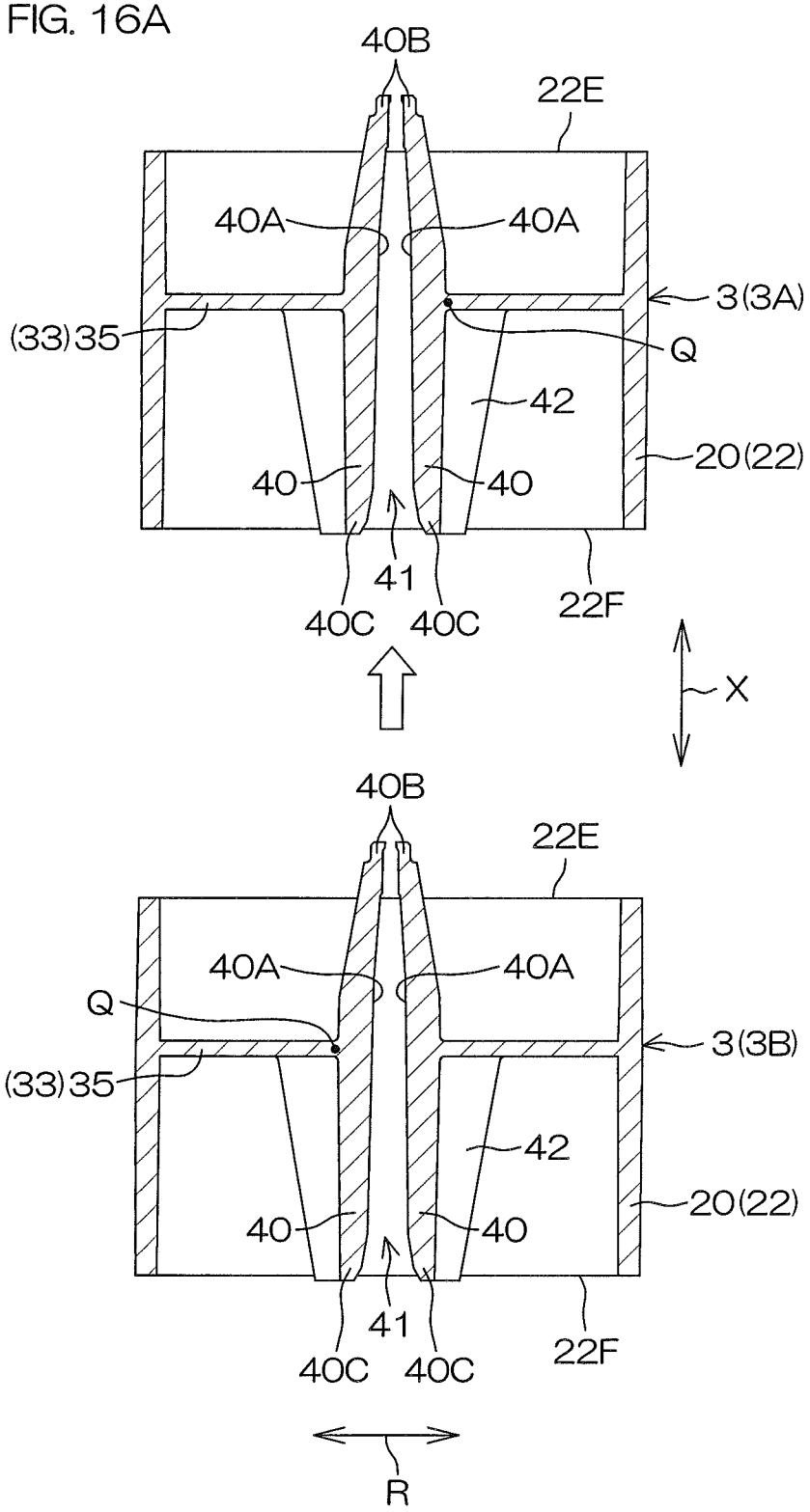
FIG. 16A relates to a second modification, and is a sectional view of two lens units 3 to be coupled.
Figure 16B:
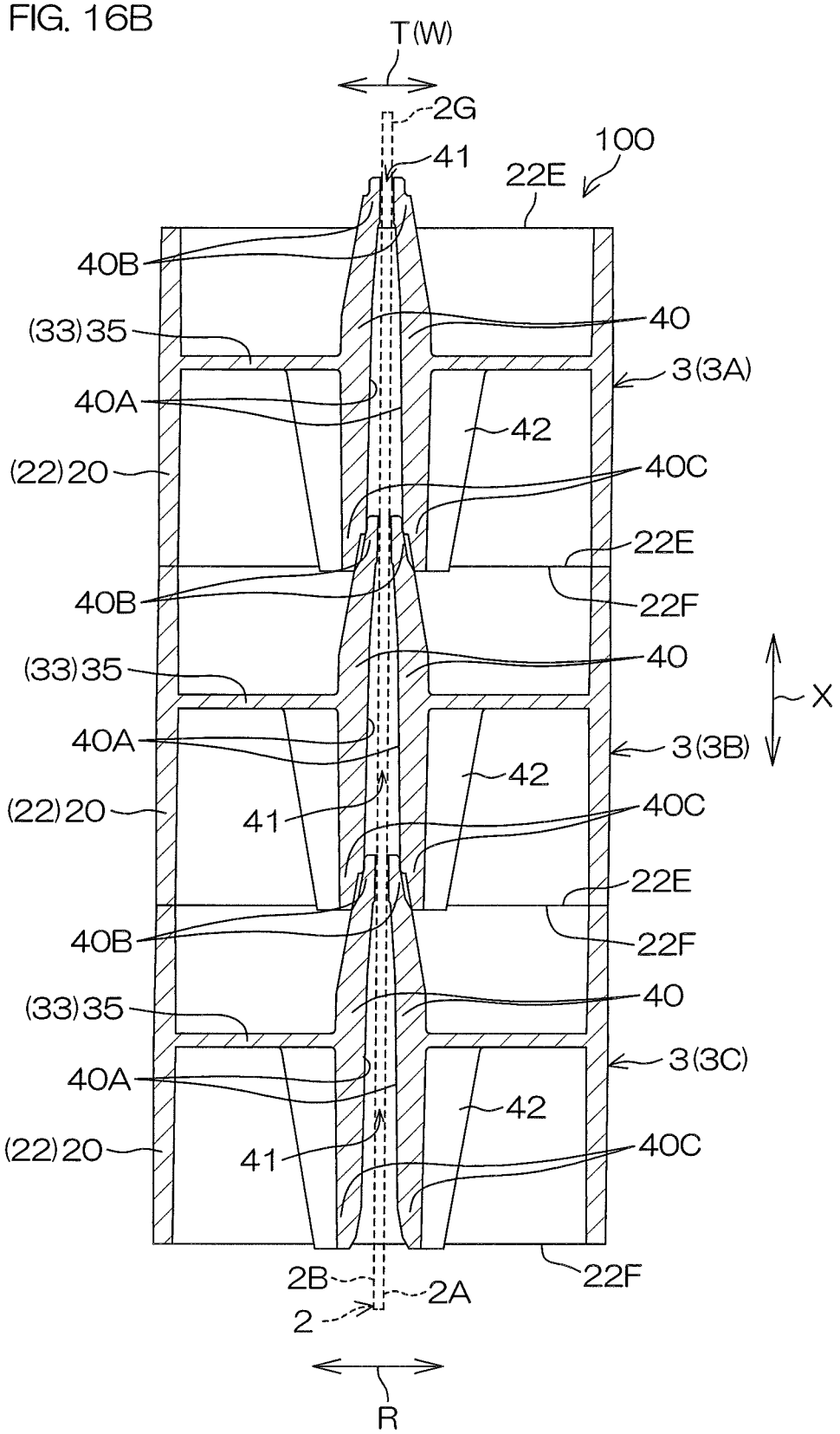
FIG. 16B relates to the second modification, and is a sectional view of three coupled lens units 3.

Also, as shown in FIG. 16A and FIG. 16B, in each lens unit 3, the light guiding radiation portion 20 may serve as the support portion 22. In this case, the support portion 22 (refer to FIG. 14A etc.,) that has existed separately from the light guiding radiation portion 20 can be omitted. Also, the lens units 3 to be coupled are supported stably on each other by the light guiding radiation portions 20 directly contacting each other.

Also, the fulcrum position (sway center of the one-end portion 40B) Q when the one-end portion 40B of each insertion space defining member 40 is elastically deformed may not be substantially the center (which is, in a strict sense, a position slightly biased to the upper side from the center, refer to FIG. 14A) of the lens unit 3 in the axial direction X. In order to make the force to sandwich the LED mounting substrate 2 by the one-end portions 40B of the pair of insertion space defining members 40 a desired magnitude, the fulcrum positions Q can be set at arbitrary positions in the axial direction X.

Figure 17A:
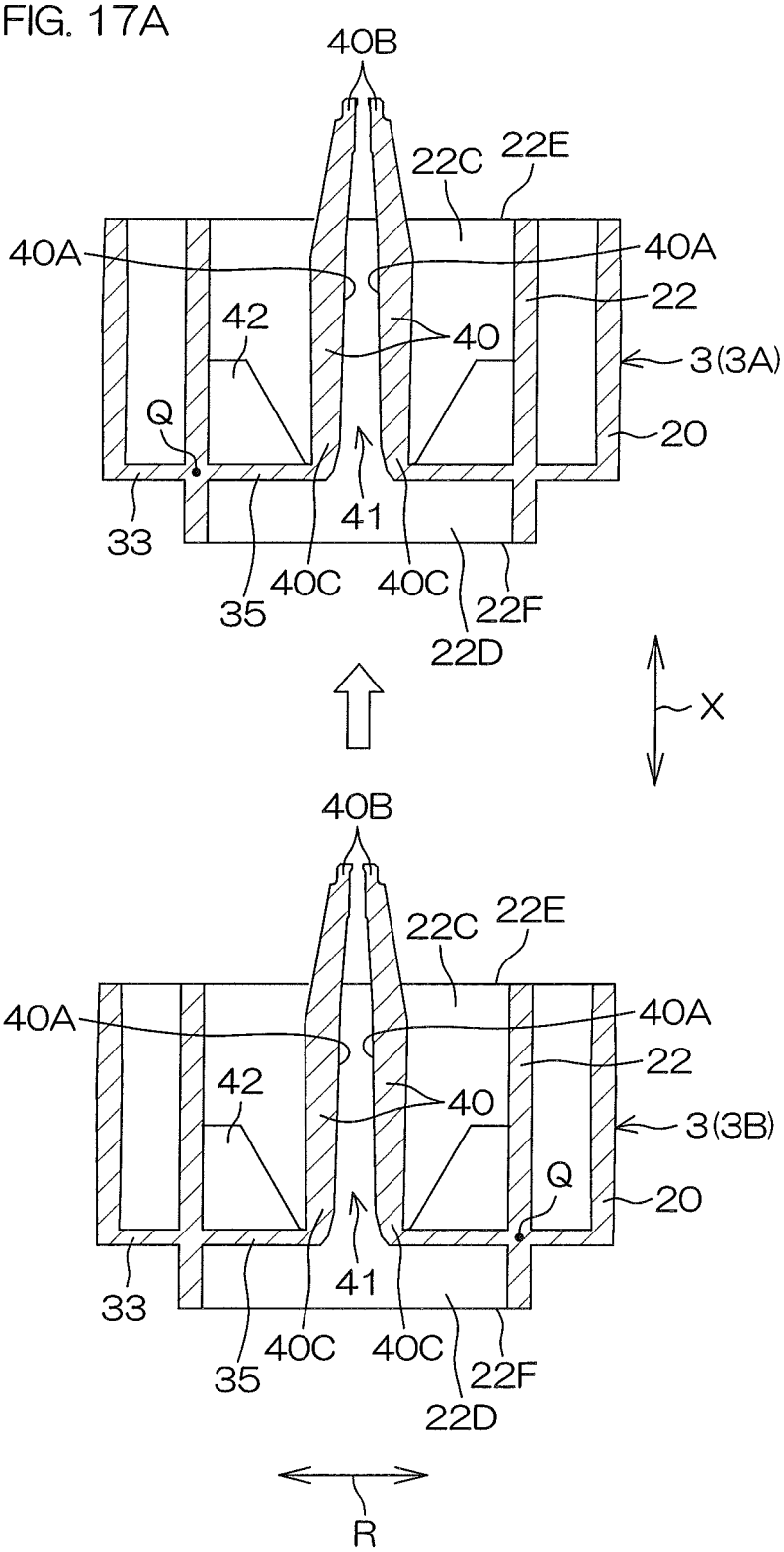
FIG. 17A relates to a third modification, and is a sectional view of two lens units 3 to be coupled.
Figure 17B:
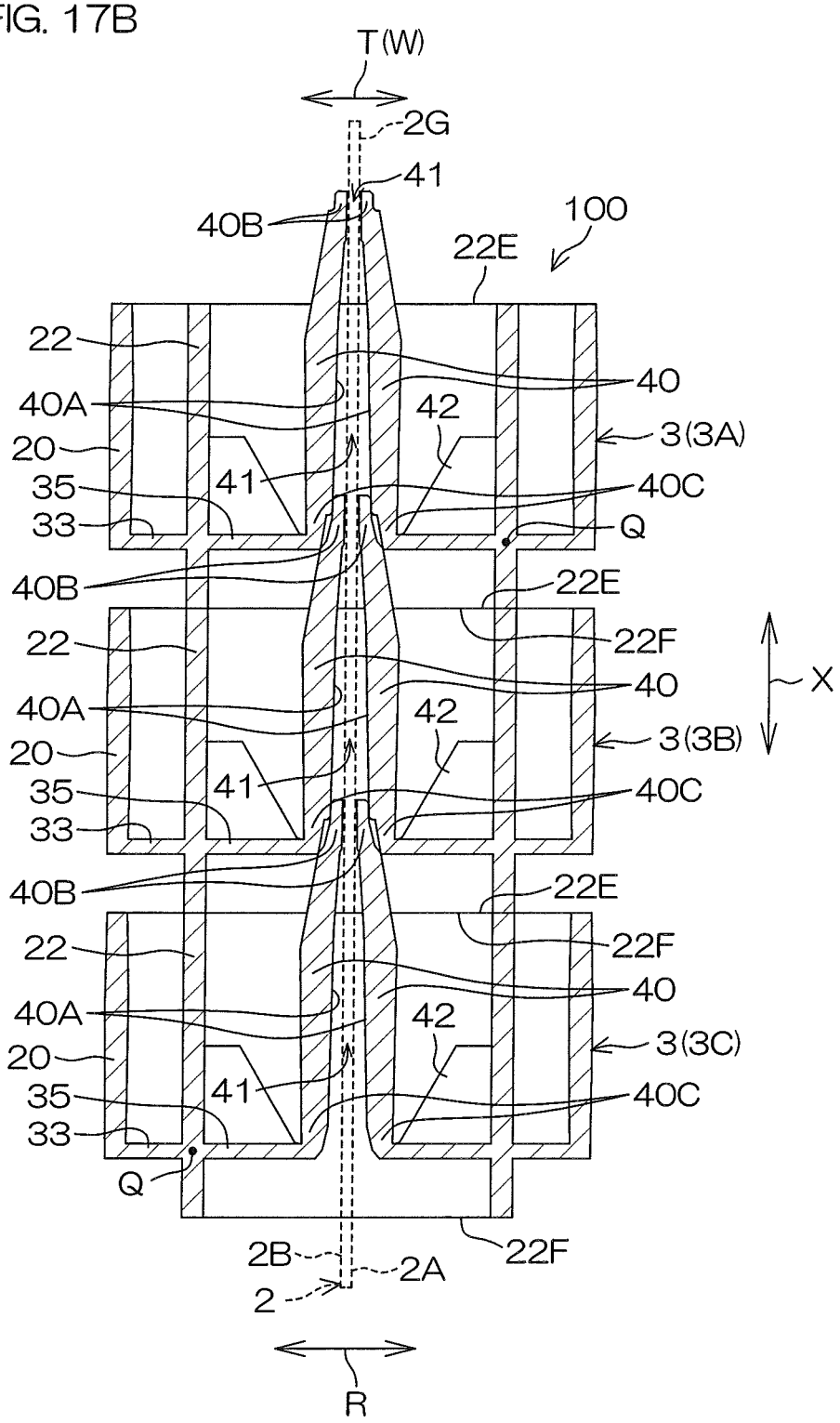
FIG. 17B relates to the third modification, and is a sectional view of three coupled lens units 3.

Also, the fulcrum position Q may be, as shown in FIG. 17A and FIG. 17B, at a connecting part of the blocking portion 35 and the support portion 22, not a connecting part of the insertion space defining member 40 and the blocking portion 35. In this case, the respective insertion space defining members 40 are coupled at the other-end portions 40C with the blocking portion 35 to become swingable together with the blocking portion 35.

Also, the auxiliary lens portion 21 (refer to FIG. 4A) may be omitted in each lens unit 3, and an auxiliary lens portion 21 may be provided for the outer lens 10.

In the preferred embodiment described above, referring to FIG. 2, the support portion 51 on the upper surface of the plate 5 has included the elastic member, but instead, at least a part of the sandwiching projections 53 of the outer top 11 may include an elastic member.

Also, the outer top 11 may be integrated as a part of the outer lens 10. In that case, the sandwiching projections 53 of the outer top 11 are provided for the outer lens 10.

Figure 18:
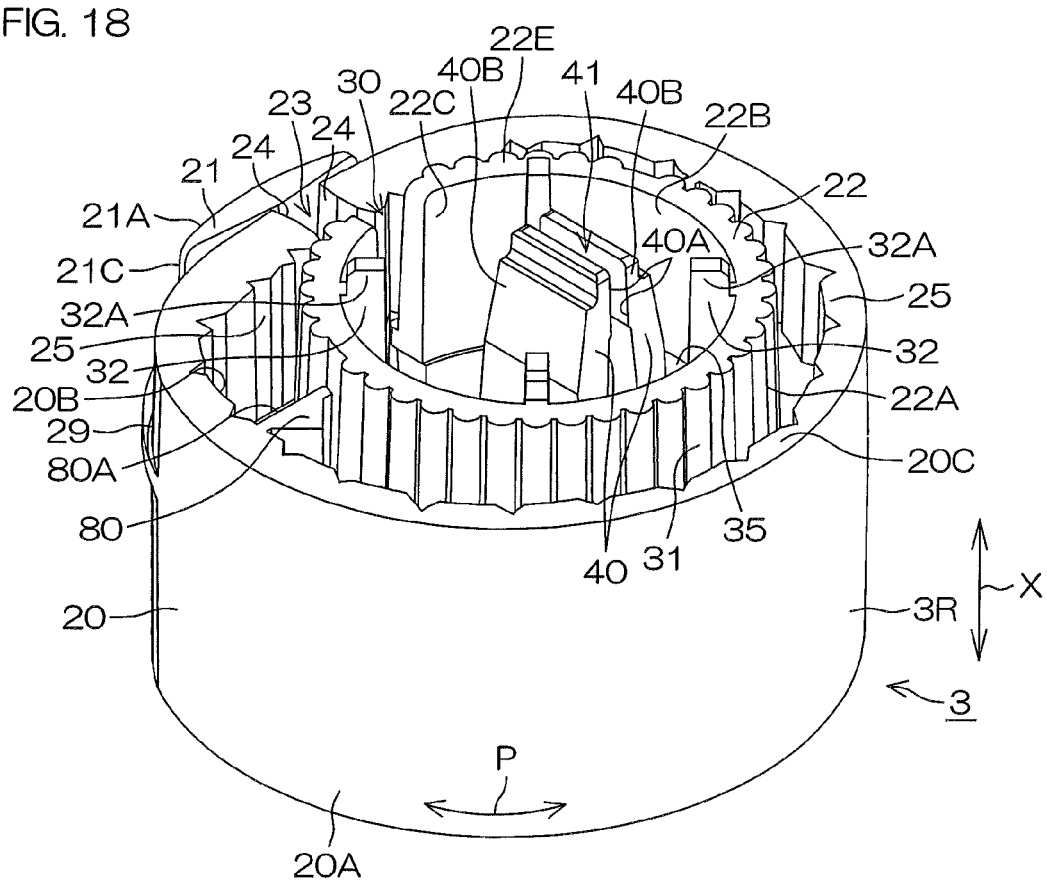
FIG. 18 is a perspective view of a lens unit 3 in a fourth modification.
Figure 19:
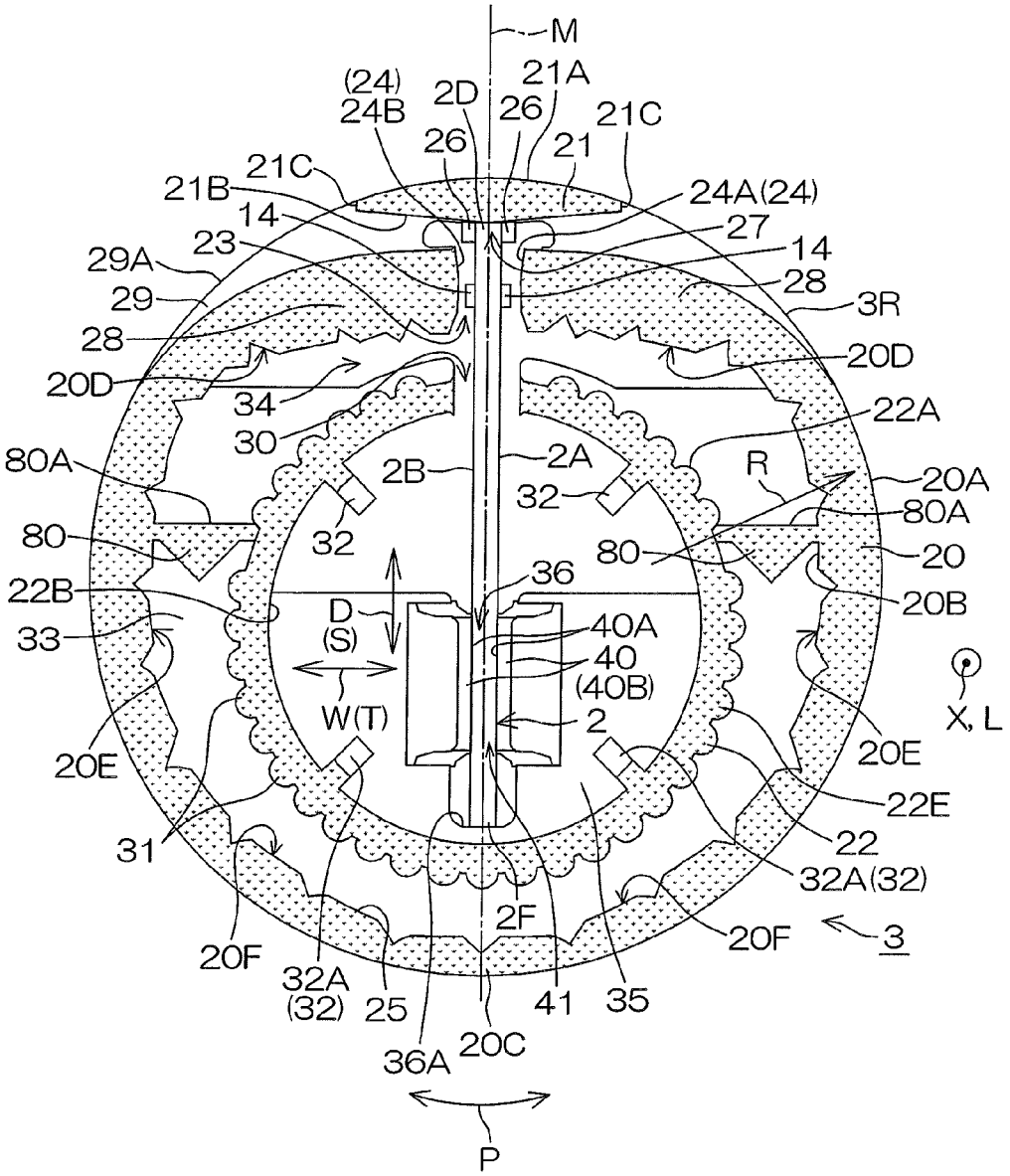
FIG. 19 is a plan view of the lens unit 3 in the fourth modification.

FIG. 18 is a perspective view of a lens unit 3 in a fourth modification. FIG. 19 is a plan view of the lens unit 3 in the fourth modification.

The lens unit 3 of the fourth modification shown in FIG. 18 and FIG. 19 includes inner irradiation portions 80 inside of the light guiding radiation portion 20 and outside of the support portion 22 (that is, between the light guiding radiation portion 20 and the support portion 22). The inner irradiation portions 80 are provided as a pair so as to be arranged on both sides of the support portion 22 in the width direction W described above. Each inner irradiation portion 80 is arranged at a position shifted by approximately +90 degrees or −90 degrees from the slit portion 23 in the circumferential direction P. Each inner irradiation portion 80 is in a pillar shape extending along the axis direction X from the coupling portion 33. Each inner irradiation portion 80 when cut along a plane orthogonal to the axial direction X shows a substantially triangular shape that is narrowed toward the opposite position 20C of the light guiding radiation portion 20. Therefore, an end face 80A at the slit portion 23 side in each inner irradiation portion 80 is a flat surface along both of the width direction W and the axial direction X. In addition, each inner irradiation portion 80 is disposed between the light guiding radiation portion 20 and the support portion 22 (refer to FIG. 19), but without limitation thereto, each inner irradiation portion 80 may not be connected to either or one of the light guiding radiation portion 20 and the support portion 22.

When light has leaked to the inside of the light guiding radiation portion 20 with light emission of the LEDs 14, a part of the light is irradiated to the slit portion 23 side (which is, in a strict sense, the first region 20D side of the light guiding radiation portion 20, and in the case of FIG. 19, a region immediately above the end face 80A) from the end face 80A by the inner irradiation portion 80. Of the thus irradiated light, light having reached the first region 20D is radiated outward from the light guiding radiation portion 20 in the first region 20D. Also, light having reached the slit portion 23 side after being irradiated by the inner irradiation portion 80 is radiated outward by the auxiliary lens portion 21 through the slit portion 23. Thereby, in the signal indicator lamp 1, the light quantity of light to be radiated outward from the light guiding radiation portion 20 can be uniformized in the circumferential direction P.

In the preferred embodiment described above, the sectional shapes of the projection portions 25 in the inner peripheral surface 20B of the light guiding radiation portion 20 have been different among the first region 20D, the second region 20E, and the third region 20F (refer to FIG. 6 to FIG. 8), but as in the fourth modification, the sectional shapes of the projection portions 25 may be identical in the entire region of the first region 20D to the third region 20F. In this case, the sectional shape of each projection portion 25 is a shape similar to the sectional shape (refer to FIG. 6 to FIG. 8) of the projection portions 25 in the original second region 20E. Therefore, each projection portion 25 when cut along a cutting plane orthogonal to the axial direction X has a basic sectional form that is identical wherever the position in the circumferential direction P of the inner peripheral surface 20B is.

REFERENCE SIGNS LIST

1 . . . Signal indicator lamp
2 . . . LED mounting substrate

2C . . . Central position
2D . . . End portion
3 . . . Lens unit
14 . . . LED
20 . . . Light guiding radiation portion
21 . . . Auxiliary lens portion
22 . . . Support portion
23 . . . Slit portion
24 . . . Incident surface
27 . . . Movement restraining portion
36A . . . Bottom face
40 . . . Insertion space defining member
40A . . . Opposite face
40B . . . One-end portion
40C . . . The other-end portion
41 . . . Insertion space
42 . . . Reinforcing portion
80 . . . Inner irradiation portion
L . . . Long-side direction
S . . . Short-side direction
T . . . Thickness direction
X . . . Axial direction

The invention claimed is:

1. A signal indicator lamp comprising an LED mounting substrate on which a plurality of sets of LEDs are mounted in a long-side direction at a predetermined interval, and made up of a plurality of consecutively provided lens units with cylindrical light guiding radiation portions provided so as to enclose the LED mounting substrate, wherein each LED is mounted at a position biased to a side from a central position in a short-side direction of the LED mounting substrate, a slit portion is defined in the light guiding radiation portion, wherein the slit is located in an axial direction such that the LED is arranged therein when the lens unit encloses the LED mounting substrate, a pair of opposite end faces of the slit portion are provided as incident surfaces of LED radiation light, and light made incident into the lens unit from the incident surfaces is guided by the light guiding radiation portion, and is radiated outward in the entire circumferential region thereof, and wherein each lens unit includes a cylindrical support portion inside the light guiding radiation portion, the cylindrical support portion is configured to support another lens unit to be coupled from an axial direction, an insertion space for the LED mounting substrate is defined inside the support portion, and a light shielding processing is applied around the entire circumference of the support portion.

2. A signal indicator lamp comprising:

an LED mounting substrate on which a plurality of sets of LEDs are mounted in a long-side direction at a predetermined interval, and made up of a plurality of consecutively provided lens units with cylindrical light guiding radiation portions provided so as to enclose the LED mounting substrate, wherein a slit portion is defined in each of the light guiding radiation portions, and wherein the slit is located in an axial direction such that the LED is arranged therein when the lens unit encloses the LED mounting substrate, an auxiliary lens portion which is provided so as to externally cover the slit portion, and outwardly radiates light leaked from the slit portion, and a first movement restraining portion which is provided in the auxiliary lens portion, is in a groove shape into which an end portion in the short-side direction of the LED mounting substrate is fitted, and restrains a movement in each of the short-side direction of the LED mounting substrate and a thickness direction thereof, wherein each LED is mounted at a position biased to a side from a central position in a short-side direction of the LED mounting substrate, a pair of opposite end faces of the slit portion are provided as incident surfaces of LED radiation light, and light made incident into the lens unit from the incident surfaces is guided by the light guiding radiation portion, and is radiated outward in the entire circumferential region thereof.

3. The signal indicator lamp according to claim 2, comprising a second movement restraining portion which is provided at a side opposite to the auxiliary lens portion in the short-side direction of the LED mounting substrate, and restrains a movement of the LED mounting substrate to the opposite side.

4. A signal indicator lamp comprising:

an LED mounting substrate on which a plurality of sets of LEDs are mounted in a long-side direction at a predetermined interval, and made up of a plurality of consecutively provided lens units with cylindrical light guiding radiation portions provided so as to enclose the LED mounting substrate, wherein each LED is mounted at a position biased to a side from a central position in a short-side direction of the LED mounting substrate, a slit portion is defined in the light guiding radiation portion, wherein the slit is located in an axial direction such that the LED is arranged therein when the lens unit encloses the LED mounting substrate, a pair of opposite end faces of the slit portion are provided as incident surfaces of LED radiation light, and light made incident into the lens unit from the incident surfaces is guided by the light guiding radiation portion, and is radiated outward in the entire circumferential region thereof, each lens unit includes a pair of insertion space defining members which extend along an axial direction and demarcate an insertion space for the LED mounting substrate between each other's opposite faces, and the pair of insertion space defining members include one-end portions in an axial direction that are elastically deformable, and other-end portions opposite the one-end portions in an axial direction, wherein the one-end portions of a first of the plurality of consecutively provided lens units are configured to:

become proximate to each other as a result of entering between the other-end portions of a second of the plurality of consecutively provided lens units, and sandwich the LED mounting substrate in a thickness direction.

5. The signal indicator lamp according to claim 4, wherein each lens unit includes a reinforcing portion that reinforces the other-end portions in an axial direction of the pair of insertion space defining members.

6. The signal indicator lamp according to claim 1, comprising an inner irradiation portion which is provided inside the light guiding radiation portion, and irradiates light leaked to the inside of the light guiding radiation portion to the slit portion side.

* * * * *